US005795703A

United States Patent [19]

Ishikawa

[11] Patent Number: 5,795,703

[45] Date of Patent: Aug. 18, 1998

[54] METHOD FOR PROCESSING SILVER HALIDE PHOTOSENSITIVE PHOTOGRAPHIC MATERIAL

[75] Inventor: Takatoshi Ishikawa, Minami-ashigara, Japan

[73] Assignee: Fuji Photo Film Co., Ltd., Minami-ashigara, Japan

[21] Appl. No.: 763,143

[22] Filed: Dec. 10, 1996

[30] Foreign Application Priority Data

Dec. 11, 1995 [JP] Japan ..... 7-345451

[51] Int. Cl.[6] ..... G03C 7/42

[52] U.S. Cl. ..... 430/393; 430/455; 430/460

[58] Field of Search ..... 430/393, 455, 430/460

[56] References Cited

U.S. PATENT DOCUMENTS

| | | | |
|---|---|---|---|
| H953 | 8/1991 | Goto et al. | 430/455 |
| 4,378,424 | 3/1983 | Altland et al. | 430/455 |
| 5,093,228 | 3/1992 | Nakamura | 430/455 |
| 5,120,635 | 6/1992 | Sasaki et al. | 430/455 |
| 5,275,923 | 1/1994 | Fyson | 430/455 |
| 5,298,370 | 3/1994 | Kojima et al. | 430/455 |
| 5,298,373 | 3/1994 | Sasaoka et al. | 430/455 |
| 5,358,832 | 10/1994 | Millington et al. | 430/455 |
| 5,389,501 | 2/1995 | Rogers et al. | 430/393 |
| 5,401,621 | 3/1995 | Kojima et al. | 430/455 |
| 5,415,983 | 5/1995 | Kojima et al. | 430/455 |
| 5,427,895 | 6/1995 | Hayashi | 430/455 |

FOREIGN PATENT DOCUMENTS

| | | |
|---|---|---|
| 431568 | 6/1991 | European Pat. Off. . |
| 569008 | 11/1993 | European Pat. Off. . |
| 143755 | 5/1992 | Japan . |
| 143757 | 5/1992 | Japan . |
| 143765 | 5/1992 | Japan . |
| 51455 | 2/1994 | Japan . |
| 168334 | 7/1995 | Japan . |

*Primary Examiner*—Hoa Van Le

*Attorney, Agent, or Firm*—Burns, Doane, Swecker & Mathis, LLP

[57] ABSTRACT

A method for processing silver halide photosensitive photographic material comprises the steps of developing an image-exposed silver halide photosensitive material and desilvering it with a processing solution having fixing function which contains a thiosulfate radical and a specified meso-ionic compound or a specified thiourea, an amount of ammonium ion in the solution being 0 to 50% based on the total counter cations in the solution. This method can provide processed silver halide photosensitive photographic material having excellent photographic properties while keeping a low stain concentration with even a small amount of a replenisher.

17 Claims, No Drawings

METHOD FOR PROCESSING SILVER HALIDE PHOTOSENSITIVE PHOTOGRAPHIC MATERIAL

BACKGROUND OF THE INVENTION

The present invention relates to a method for processing silver halide photosensitive photographic materials. In particular, the invention relates to a processing method suitable for the environmental protection and capable of exhibiting sufficient desilverizing and photographic properties even when the replenisher having a low ammonium salt content is supplied in only a small amount.

Silver halide color photosensitive photographic materials are usually processed by a method comprising a color development step, desilvering step, washing step with water and stabilizing step. In the desilvering step, the developed silver formed in the color developing step is oxidized (bleached) with a bleaching agent having an oxidizing effect to form a silver salt and then the silver salt is removed from the photosensitive layer with a fixing agent capable of forming a soluble silver salt together with the unused silver halide (fixing step). The bleaching and fixing are conducted separately from each other in bleaching and fixing steps or, alternatively, at the same time in a bleach-fixing step. The details of these processing steps are described in James, "The Theory of Photographic Process", 4th edition (1977).

In processing a black-and-white photosensitive materials, the developing step is followed by the fixing step.

In these processing steps, a highly active solution called "replenisher" is usually fed into the processing solution in a tank so as to keep the processing function of the latter. Further, ammonium ion has been used hitherto for the purpose of improving the activity. By the addition of the replenisher, a part of the solution in the tank is usually discharged as so-called "overflow".

However, from the viewpoint of the problem of the recent global environmental pollution, a countermeasure to the waste liquid is also necessary as a matter of course. The best measures include the reduction in the quantity of the waste liquids as far as possible. The simplest method for reducing the quantity of the waste liquid is to reduce the quantity of the replenisher. However, it has been found that when the quantity of the replenisher having the fixing function is simply reduced, the fixing capacity is seriously reduced and, in addition, the stain of the processed photosensitive material (coloring of the unexposed parts) becomes serious.

Various techniques of reducing ammonium ion concentration in the fixing solution have been proposed hitherto for solving the above-described problems of the environmental pollution. In particular, although U. S. Pat. No. 5,275,923 discloses a technique wherein a combination of an alkali metal thiosulfate with ammonium thiosulfate is used, this technique has a defect that the desilvering rate is reduced. Further, although U. S. Pat. No. 5,389,501, E.P. No. 569008A and Japanese Patent Unexamined Published Application (hereinafter referred to as "J.P. KOKAI") No. Hei 7-168334 disclose a technique of accelerating the fixing by using a thioether compound, the satisfactory accelerating effect has never been obtained.

When a meso-ionic radical described in J. P. KOKAI Nos. Hei 4-143757, 4-143765 and 4-143755 is used in place of the thiosulfate radical, the problem is not solved. Under these conditions, it has been demanded to solve the problems.

SUMMARY OF THE INVENTION

Therefore, the first object of the present invention is to provide a processing composition having only a low ammonium salt concentration or free from the ammonium salt and excellent in the fixing properties, and also a processing method with the composition.

The second object of the invention is to provide a method capable of obtaining excellent photographic properties while keeping a low stain concentration with even a small amount of a replenisher.

It has been found that the above-described problems can be solved by the following method:

A method for processing a silver halide photosensitive photographic material which comprises the steps of developing after an image-exposed silver halide photosensitive material and desilvering it with a processing solution having fixing function which contains a thiosulfate radical and a compound selected from the group consisting of the compounds represented by the following general formulae (I) and (II), an amount of ammonium ion in the solution being 0 to 50% based on the total counter cations in the solution:

general formula (I)

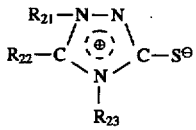

wherein $R_{21}$, $R_{22}$ and $R_{23}$, which may be the same or different from each other, each represent a hydrogen atom, alkyl group, cycloalkyl group, alkenyl group, alkynyl group, aralkyl group, aryl group, heterocyclic group, amino group, acylamino group, sulfonamido group, ureido group, sulfamoylamino group, acyl group, thioacyl group, carbamoyl group or thiocarbamoyl group, with the proviso that both $R_{21}$, and $R_{23}$ cannot be a hydrogen atom at the same time, and general formula (II):

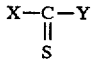

wherein X and Y, which may be the same or different from each other, each represent an alkyl group, alkenyl group, aralkyl group, aryl group, heterocyclic group, $—N(R_{31})R_{32}$, $—N(R_{33})N(R_{34})R_{35}$, $—OR_{36}$ or $—SR_{37}$, or X and Y may together form a ring, with the proviso that at least one (preferably 1 to 4, more preferably 1 or 2) of X and Y is substituted with a carboxylic acid or its salt, sulfonic acid or its salt, phosphonic acid or its salt, amino group, ammonium group or hydroxyl group; $R_{31}$, $R_{32}$, $R_{33}$, $R_{34}$ and $R_{35}$ may be the same or different from each other and each represent a hydrogen atom, alkyl group, alkenyl group, aralkyl group, aryl group or heterocyclic group, and $R_{36}$ and $R_{37}$ may be the same or different from each other and each represent a hydrogen atom, cation, alkyl group, alkenyl group, aralkyl group, aryl group or heterocyclic group.

DESCRIPTION OF THE PREFERRED EMBODIMENTS

Preferred embodiments are as follows:

The method for processing a silver halide photosensitive photographic material wherein the silver halide photosensitive material is a color photosensitive material.

The method for processing a silver halide photosensitive photographic material wherein an emulsion layer of the silver halide photosensitive material comprises silver bromoiodide emulsion.

The compounds of the above general formulae (1) and (II) are called "mesoionic compounds" or "thiourea compounds" and shown as stable fixing agents usable in place of thiosulfate radical in J. P. KOEAI Nos. Hei 4-143757, 4-143765 and 4-143755 and U.S. Pat. No. 3,565,621, and also shown as bleach-accelerating agents in J. P. KOKAI Nos. Hei 1-201659 and 2-44355. However, it has never been expected at all that when a compound of the above general formula (I) or (II) is used in combination with a thiosulfate radical in a solution having fixing function and also having a low ammonium salt concentration, excellent photographic properties such as desilvering function and inhibition of increase of stain can be obtained.

It has not been expected at all that the staining can be remarkably inhibited in the processing of color photosensitive materials.

The detailed description will be made on the compounds of the general formula (I) used in the present invention.

The alkyl, cycloalkyl, alkenyl, alkynyl, aralkyl and aryl groups represented by $R_{21}$, $R_{22}$ and $R_{23}$ each have preferably 1 to 10 carbon atoms. Each of $R_{21}$, $R_{22}$ and $R_{23}$ is particularly preferably a hydrogen atom or alkyl group having 1 to 5 carbon atoms. These groups may be substituted with various substituents. Examples of the preferred substituents include a hydroxyl group, amino groups, sulfonic acid groups, carboxylic acid groups, nitro group, phosphoric acid groups, halogen atoms, alkoxy groups, mercapto group, cyano group, alkylthio groups, sulfonyl groups, carbamoyl groups, carbonamido groups, sulfonamido groups, acyloxy groups, sulfonyloxy groups, ureido groups and thioureido groups. In a preferred structure, one of $R_{21}$, $R_{22}$ and $R_{23}$ is an alkyl group substituted with a water-soluble group. The term "water-soluble group" herein indicates a hydroxyl amino, sulfonic acid, carboxylic acid or phosphoric acid group. The alkyl group has preferably 1 to 4 carbon atoms. Among them, sulfonic acid group or carboxylic acid group is particularly preferred.

Examples of the compounds used in the present invention are as follows, which by no means limit the invention:

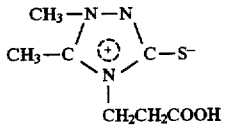
I-1

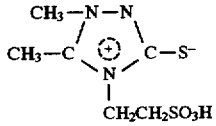
I-2

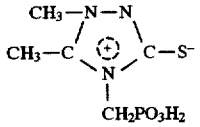
I-3

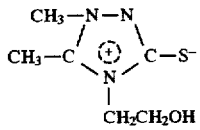
I-4

-continued

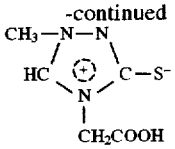
I-5

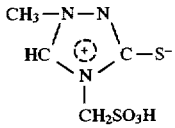
I-6

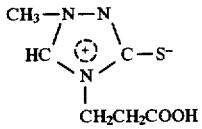
I-7

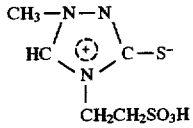
I-8

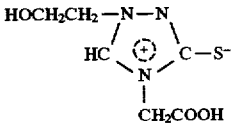
I-9

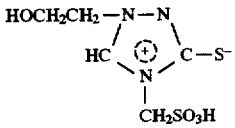
I-10

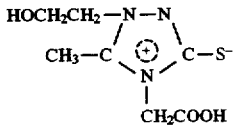
I-11

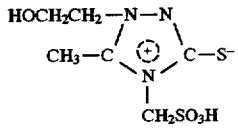
I-12

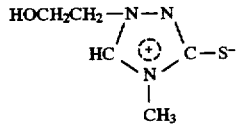
I-13

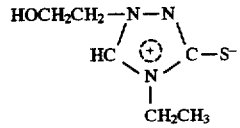
I-14

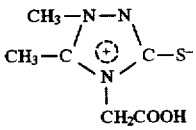
I-15

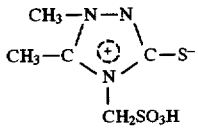
I-16

-continued
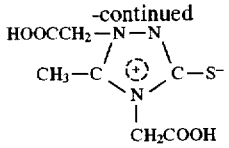
I-17
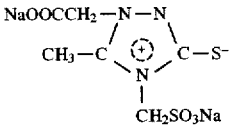
I-18
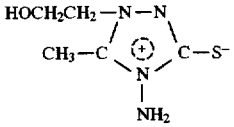
I-19
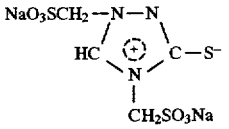
I-20
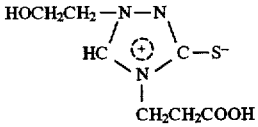
I-21
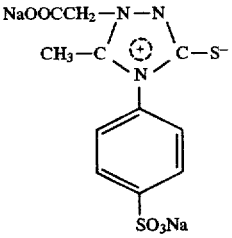
I-22
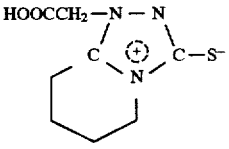
I-23
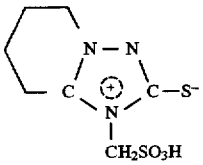
I-24
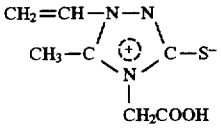
I-25
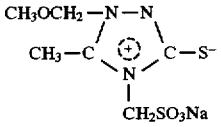
I-26
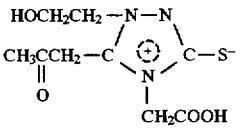
I-27
-continued
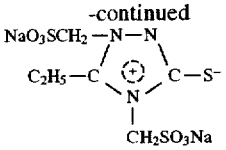
I-28
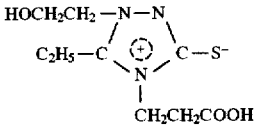
I-29
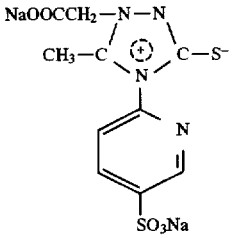
I-30
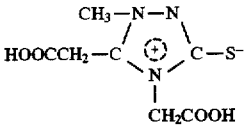
I-31
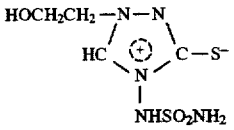
I-32
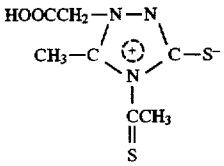
I-33
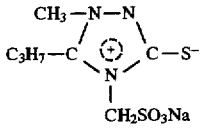
I-34
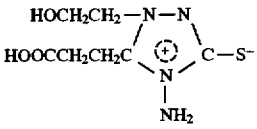
I-35
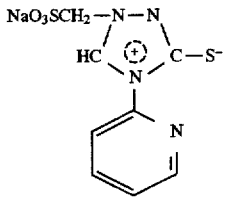
I-36
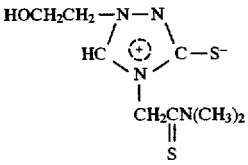
I-37

-continued

I-38

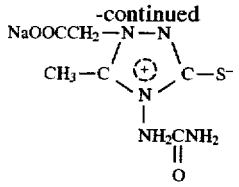

I-39

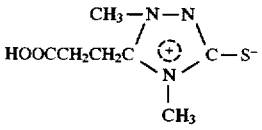

I-40

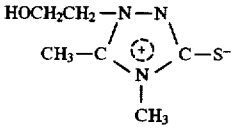

I-41

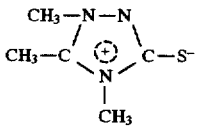

I-42

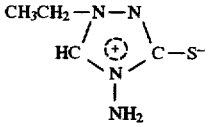

I-43

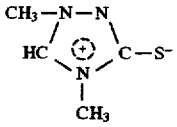

I-44

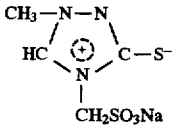

I-45

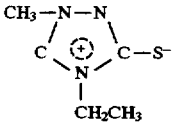

I-46

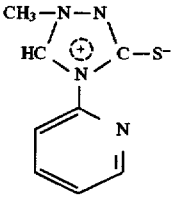

I-47

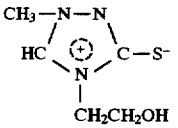

I-48

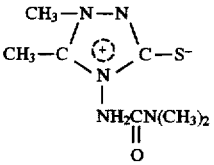

-continued

I-49

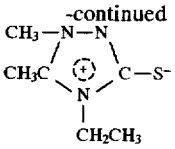

I-50

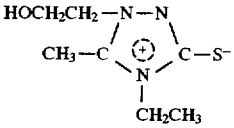

The compounds of the general formula (I) usable in the present invention can be synthesized by methods described in, for example, J. Heterocyclic Chem. 2, 105 (1965), J. Org. Chem. 32, 2245 (1967), J. Chem. Soc. 3799 (1969), J. P. KOKAI Nos. Sho 60-87322, 60-122936 and 60-117240 and J. P. KOKAI No. Hei 4-143757.

The detailed description will be made on the compounds of the general formula (II) usable in the present invention.

Examples of the alkyl, alkenyl, aralkyl, aryl and heterocyclic groups represented by X, Y, $R_{31}$, $R_{32}$, $R_{33}$, $R_{34}$, $R_{35}$, $R_{36}$ and $R_{37}$ include substituted or unsubstituted alkyl groups having 1 to 10 carbon atoms (such as methyl, ethyl, propyl, hexyl, isoproyl, carboxyethyl, sulfoethyl, aminoethyl, dimethylaminoethyl, phosphonopropyl, carboxymethyl and hydroxyethyl groups), substituted or unsubstituted alkenyl groups having 2 to 10 carbon atoms (such as vinyl, propinyl and 1-methylvinyl groups), substituted or unsubstituted aralkyl groups having 7 to 12 carbon atoms (such as benzyl, phenethyl, 3-carboxyphenylmethyl and 4-sulfophenylethyl groups), substituted or unsubstituted aryl groups having 6 to 12 carbon atoms (such as phenyl, naphthyl, 4-carboxyphenyl and 3-sulfophenyl groups), substituted or unsubstituted heterocyclic groups having 1 to 10 carbon atoms (such as preferable those having 5- or 6-membered ring, e. g. pyridyl, furyl, thienyl, imidazolyl, pyrrolyl, pyrazolyl, pyrimidinyl, quinolyl, piperidyl and pyrrolidyl groups).

The cationic groups represented by $R_{36}$ and $R_{37}$ in the general formula (II) indicate alkali metal and ammonium group.

X and Y may form a ring together. The rings formed by X and Y include, for example, imidazoline-2-thion ring, imidazolidine-2-thion ring, thiazoline-2-thion ring, thiazolidine-2-thion ring, oxazoline-2-thion ring, oxazolidine-2-thion ring, pyrrodidine-2-thion ring and benzo-condensed rings of them.

However, at least one of X and Y should be substituted with at least one of carboxylic acids and salts thereof (such as an alkali metal salts and ammonium salts), sulfonic acids and salts thereof (such as alkali metal salts and ammonium salts), phosphonic acids and salts thereof (such as alkali metal salts or ammonium salts), amino groups (such as unsubstituted amino group, dimethylamino group, methylamino group and dimethylamino group hydrochloride), ammonium groups (such as trimethylammonium group and dimethylbenzylammonium group) and hydroxyl group.

The alkyl, alkenyl, aralkyl, aryl and heterocyclic groups may be substituted.

The substituents include those described below.

Typical substituents include, for example, alkyl, aralkyl, alkenyl, alkynyl, aryl, alkoxy, aryloxy, acylamino, ureido, urethane, sullfonylamino, sulfamoyl, carbamoyl, sulfonyl, sulfinyl, alkyloxycarbonyl, aryloxycarbonyl, acyl, acyloxy, alkylthio, arylthio, cyano and nitro groups and halogen atoms. When the group has two or more substituents, they may be the same or different from each other.

The compounds of the general formula (II) are preferably those represented by the following general formula (III):

general formula (III)

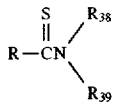

wherein R represents an alkyl group having 1 to 10 carbon atoms, —N($R_{40}$) $R_{41}$ having 0 to 10 carbon atoms or —N($R_{42}$)N($R_{43}$)$R_{44}$ having 0 to 10 carbon atoms, $R_{38}$, $R_{39}$, $R_{40}$, $R_{41}$, $R_{42}$, $R_{43}$ and $R_{44}$ each represent a hydrogen atom or alkyl group (preferably having 1 to 5 carbon atoms), with the proviso that at least one of R, $R_{38}$, $R_{39}$, $R_{40}$, $R_{41}$, $R_{42}$, $R_{43}$ and $R_{44}$ represents an alkyl group substituted with a carboxylic acid or a salt thereof, sulfonic acid or salt thereof, phosphonic acid or salt thereof, amino group, ammonium group or hydroxyl group.

In the general formula (III), R more preferably represents —N($R_{40}$)$R_{41}$ having 0 to 6 carbon atoms or —N($R_{42}$)N($R_{43}$) $R_{44}$ having 0 to 6 carbon atoms.

$R_{38}$, $R_{39}$, $R_{40}$, $R_{41}$, $R_{42}$, $R_{43}$ and $R_{44}$ each represent a hydrogen atom or alkyl group, with the proviso that at least one (preferably one to four) of $R_{38}$, $R_{39}$, $R_{40}$, $R_{41}$, $R_{42}$, $R_{43}$ and $R_{44}$ represents an alkyl group substituted with a group selected from among groups of carboxylic acids and salts thereof, sulfonic acids and salts thereof.

Examples of the compounds of the general formula (II) usable in the present invention are as follows, which by no means limit the invention:

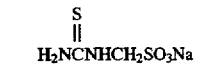
II-1

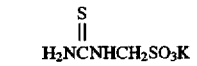
II-2

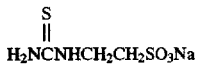
II-3

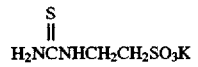
II-4

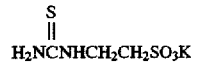
II-5

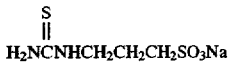
II-6

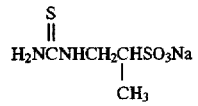
II-7

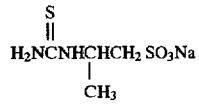
II-8

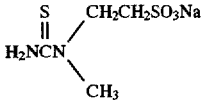
II-9

-continued

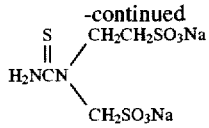
II-10

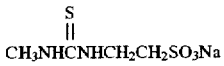
II-11

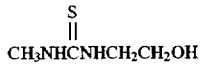
II-12

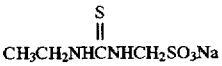
II-13

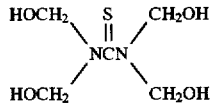
II-14

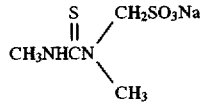
II-15

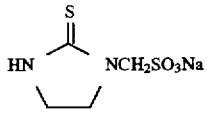
II-16

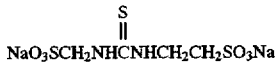
II-17

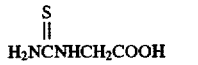
II-18

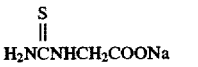
II-19

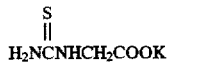
II-20

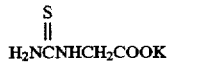
II-21

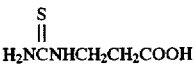
II-22

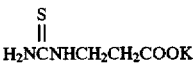
II-23

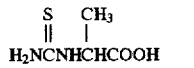
II-24

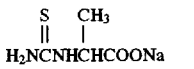
II-25

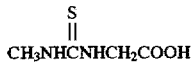
II-26

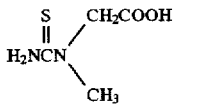
II-27

-continued
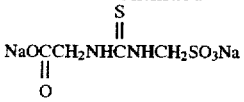
II-28
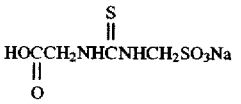
II-29
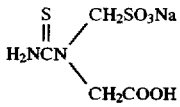
II-30
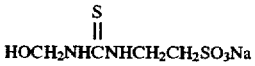
II-31
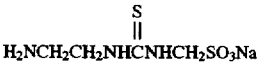
II-32
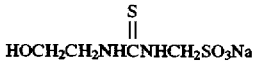
II-33
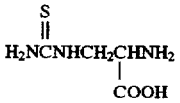
II-34
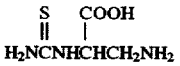
II-35
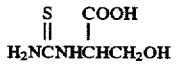
II-36
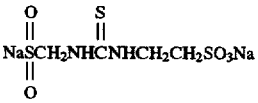
II-37
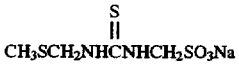
II-38
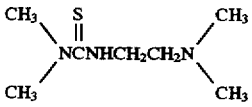
II-39
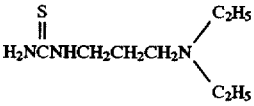
II-40
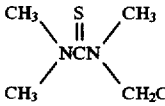
II-41
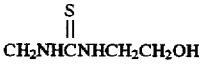
II-42
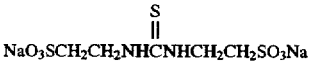
II-43
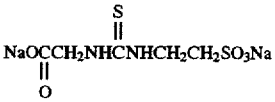
II-44
-continued
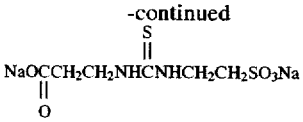
II-45
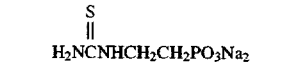
II-49
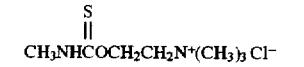
II-50
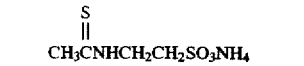
II-51
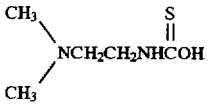
II-52
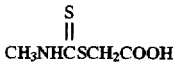
II-53
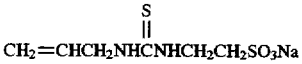
II-54
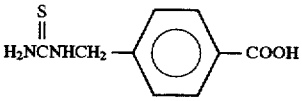
II-55
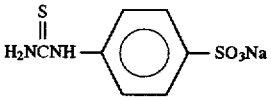
II-56
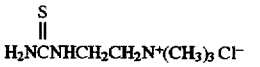
II-55
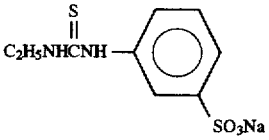
II-58
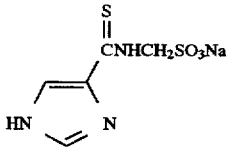
II-59
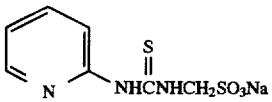
II-60
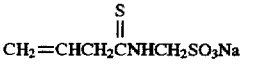
II-61
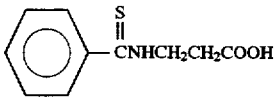
II-62
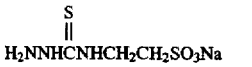
II-63
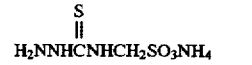
II-64

-continued
II-65
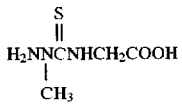
II-66
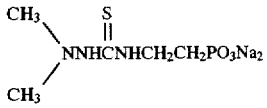
II-67
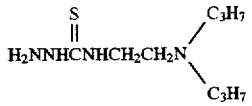
II-68
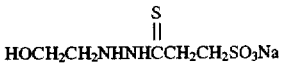
II-69
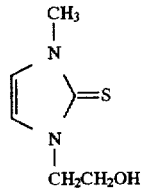
II-70
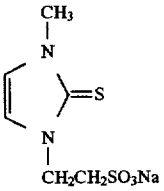
II-71
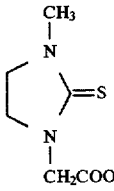
II-72
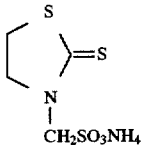
II-73
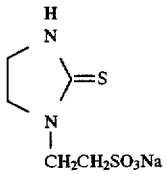
II-74
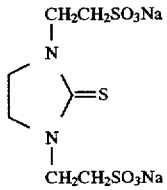
-continued
II-75
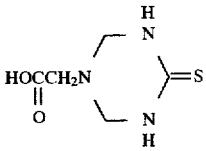
II-76
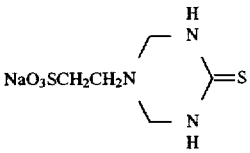
II-77
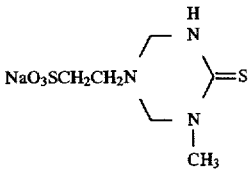
II-78
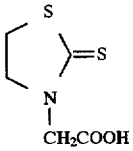
II-79
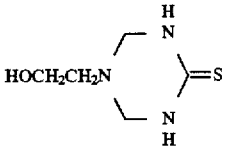
II-80
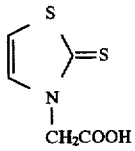
II-81
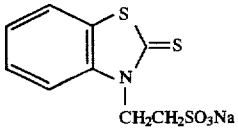
II-82
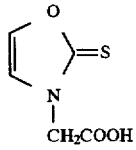
II-83
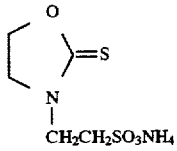
II-84
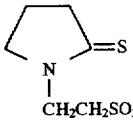

-continued

II-85

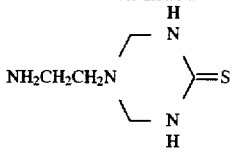

The compounds of the general formula (II) of the present invention can be synthesized with reference to known methods described in, for example, J. Org. Chem. 24, 470–473, (1959), J. Heterocycl. Chem. 4, 605–609 (1967), "Yakushi" 82, 36–45 (1962), Japanese Patent Publication for Opposition Purpose (hereinafter referred to as "J. P. KOKOKU") No. Sho 39-26203, J. P. KOKAI No. Sho 63-229449 and OLS-2,043,944.

The above-described compound (I) or (II) is added to a bath having fixing function in combination with thiosulfate radical. The amount of such a compound is 0.001 to 2 mols/l, preferably 0.01 to 1 mol/l.

The amount of this compound is such that the molar ratio thereof to the thiosulfuric acid salt is about 0.02:1 to 0.3:1, preferably 0.03:1 to 0.25:1.

Two or more of the compounds of the general formula (I) or (II) may be used in the present invention. In such a case, the molar ratio of the total amount of these compounds to the sulfuric acid radical of the thiosulfuric acid salt is most preferably in the above-described range.

The details of the bath having the fixing function of the present invention will be described below.

Now, the detailed description will be given on the processing method of the present invention.

A color developer used for the development of the photosensitive material of the present invention is an alkaline aqueous solution containing an aromatic primary amine color developing agent as the main ingredient. Although aminophenol compounds are usable as the color developing agent, p-phenylenediamine compounds are preferably used. Typical examples of them include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl) aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl) aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl) aniline, 4-amino-3-propyl-N-(4-hydroxybutyl)aniline and sulfates, hydrochlorides and p-toluenesulfonates of them. Among them, particularly preferred compounds are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline and hydrochlorides, p-toluenesulfonates and sulfates of them. A combination of two or more of these compounds are usable depending on the purpose.

The aromatic primary amine developing agent is used in an amount of preferably 0.0002 to 0.2 mol, more preferably 0.001 to 0.1 mol, per liter of the color developer.

The color developer may contain preservatives such as hydroxylamine, diethylhydroxylamine, hydroxylamines represented by general formula (I) in J. P. KOKAI No. 3-144446, sulfites, hydrazines, e. g. N,N-biscarboxymethylhydrazine, phenylsemicarbazides, triethanolamine and catecholsulfonic acids; organic solvents such as ethylene glycol and diethylene glycol; development accelerators such as benzyl alcohol, polyethylene glycol, quaternary ammonium salts and amines; color-forming couplers; competing couplers; assistant developing agents such as 1-phenyl-3-pyrazolidone; thickening agents; chelating agents typified by aminopolycarboxylic acids, aminopolyphosphonic acids, alkylphosphonic acids and phosphonocarboxylic acids, such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of them.

Among the preservatives, substituted hydroxylamines are the most preferred. In particular, diethylhydroxylamine, monomethylhydroxylamine and those having an alkyl group substituted with a water-soluble group such as sulfo group, carboxyl group or hydroxyl group are preferred. The most preferred examples of them include N,N-bis(2-sulfoethyl) hydroxylamine, monomethylhydroxylamine and diethylhydroxylamine.

The color developer used in the present invention can contain, if necessary, an antifoggant. The antifoggants usable herein include alkali metal halides such as sodium chloride, potassium bromide and potassium iodide and also organic antifoggants. The organic antifoggants are typified by nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The preferred pH range of the color developer used in the present invention is about 9.5 to 10.5. The pH of the developer in the tank is preferably low so as to inhibit the formation of ammonia gas from the waste solution so far as the developing activity can be kept. The most preferred pH of the solution in the tank is about 9.9 to 10.4.

Various buffering agents are preferably used for keeping the pH. Examples of the buffering agents include carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. Carbonates are particularly preferably used.

The amount of the buffering agent to be added to the developer is preferably at least 0.1 mol/l, particularly 0.1 mol/l to 0.4 mol/l.

The chelating agents are preferably biodegradable compounds such as those described in J. P. KOKAI Nos. Sho 63-146998, Sho 63-199295, Sho 63-267750, Sho 63-267751, Hei 2-229146 and Hei 3-186841, German Patent No. 3739610 and European Patent No. 468325.

The color developer in the replenisher tank or processing tank is preferably sielded with a liquid such as a high-boiling organic solvent so as to minimize the contact area thereof with air. The most preferred liquid sielding agent is liquid paraffin. It is particularly suitably used for the replenisher.

The processing temperature is 30° to 55° C., preferably 35° to 55° C., when the color developer of the present invention is used. The processing time for the photographic sensitive material for photography is 20 seconds to 5 minutes, preferably 30 seconds to 3 minutes and 20 seconds.

The amount of the replenisher is 30 to 800 ml, preferably 50 to 500 ml, per square meter of the photosensitive material.

When the reversal development is conducted, usually the black-and-white development is followed by the color development. The black-and-white developer contains a known black-and-white developing agent such as a dihydroxybenzene, e. g. hydroquinone, a 3-pyrazolidone, e. g. 1-phenyl-3-pyrazolidone or an aminophenol, e. g. N-methyl-p-aminophenol either singly or in combination of two or more of them.

When a black-and-white photosensitive material is to be processed, known developers other than those described below are also usable.

The developer used in the present invention can contain a development accelerator, if necessary.

The development accelerators include thioether compounds described in J. P. KOKOKU Nos. Sho 37-16088, 37-5987, 38-7826, 44-12380 and 45-9019 and U.S. Pat. No. 3,813,247, p-phenylenediamine compounds described in J. P. KOKAI Nos. Sho 52-49829 and 50-15554, quaternary ammonium salts described in J. P. KOKAI Nos. Sho 50-137726, J. P. KOKOKU No. Sho 4-30074 and J. P. KOKAI Nos. Sho 56-156826 and Sho 52-43429, amine compounds described in U.S. Pat. Nos. 2,494,903, 3,128,182, 4,230,796 and 3,253,919, J. P. KOKOKU Nos. Sho 41-11431, and U.S. Pat. Nos. 2,482,546, 2,596,926 and 3,582,346, polyalkylene oxides described in J. P. KOKOKU Nos. Sho 37-16088 and 42-25201, U.S. Pat. No. 3,128,183, J. P. KOKOKU Nos. Sho 41-11431 and 42-23883 and U.S. Pat. No. 3,532,501, as well as 1-phenyl-3-pyrazolidones and imidazoles.

The detailed description will be given on the desilvering steps of the present invention.

The desilvering steps usually comprise various steps including bleaching step, bleach-fixing step and fixing step. An example of these steps is given below, which by no means limit the desilvering steps:

(step 1) bleach-fixing (step 2) bleaching—bleach-fixing (step 3) bleaching—bleach-fixing-fixing (step 4) fixing—bleach-fixing (step 5) bleaching—fixing.

When a black-and-white photosensitive material is used, only the fixing is conducted usually.

In the present invention, the steps 1, 2, 3 and 4 wherein the bleach-fixing solution is used are preferred. Particularly when the technique of the present invention is employed with a bleach-fixing solution, the desilvering effect is remarkably improved and the fading resistance of the photosensitive material to light is also improved.

The bleaching agents used for preparing the processing solution having the bleaching function include iron (III) aminopolycarboxylate complexes, persulfates, bromates, hydrogen peroxide and potassium ferricyanide. Among them, the iron (III) aminopolycarboxylate complexes are most preferably used.

In the present invention, the ferric complex salt may be used in the form of a previously produced iron complex salt to be dissolved or, alternatively, both of a complex-forming compound and a ferric salt [such as ferric sulfate, ferric chloride, ferric bromide, iron (III) nitrate or iron (III) ammonium sulfate] may be used to form a complex salt in the solution having the bleaching function.

The complex-forming compound can be used in an amount slightly larger than that necessitated for forming the complex with ferric ion. When it is used in an excess amount, the amount is preferably 0.01 to 10% over the stoichiometric amount.

Examples of the compounds capable of forming the ferric complex salt in the solution having the bleaching function in the present invention include ethylenediaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl)iminodipropionic acid, β-alaninediacetic acid, 1,4-diaminobutanetetraacetic acid, glycol ether diaminetetraacetic acid, N-(2-carboxyphenyl) iminodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid and 1,3-diaminopropane-N,N'-dimalonic acid. These examples by no means limit the compounds.

The concentration of the ferric complex salt in the processing solution having the bleaching function is in the range of 0.005 to 1.0 mol/l, preferably in the range of 0.01 to 0.50 mol/l and more preferably 0.02 to 0.30 mol/l.

The concentration of the ferric complex salt in the replenisher having the bleaching function is preferably 0.005 to 2 mol/l and more preferably 0.01 to 1.0 mol/l.

The bath having the bleaching function or the prebath can contain various compounds as the bleaching accelerator. Preferred are compounds having a high bleaching power such as those having a mercapto group or disulfide bond described in U.S. Pat. No. 3,893,858, German Patent No. 1,290,812, J. P. KOKAI No. Sho 53-95630 and Research Disclosure No. 17129 (July, 1978), thiourea compounds described in J. P. KOKOKU No. Sho 45-8506, J. P. KOKAI Nos. 52-20832 and 53-32735 and U.S. Pat. No. 3,706,561, and halides containing iodine or bromine ion.

The bath having the bleaching function and usable in the present invention can contain a rehalogenating agent such as a bromide (e. g. potassium, sodium or ammonium bromide), chloride (e. g. potassium, sodium or ammonium chloride) or iodide (e. g. ammonium iodide). If necessary, the bath can contain one or more inorganic or organic acids having a pH buffering function such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid and glutaric acid, as well as alkali metal and ammonium salts of them; and a corrosion inhibitor such as ammonium nitrate or guanidine.

The bath having the bleaching function can further contain various fluorescent brighteners, defoaming agents, surfactants and organic solvents such as polyvinylpyrrolidone and methanol.

The fixing components in the bleach-fixing solution and fixing solution are the above-described thiosulfates and compounds of the general formula (I) or (II). The thiosulfates include, for example, sodium thiosulfate, potassium thiosulfate and ammonium thiosulfate. They further include well-known fixing agents; thiocyanates such as sodium thiocyanate and ammonium thiocyanate; and water-soluble silver halide-dissolving agents such as thioether compounds and thioureas, e. g. ethylenebisthioglycolic acid and 3,6-dithia-1,8-octanediol. They can be used either singly or in the form of a mixture of two or more of them. In the present invention, the thiosulfates, particularly sodium thiosulfate and potassium thiosulfate are preferably used. The total amount of the fixing agent(s) is preferably in the range of 0.3 to 3 mol, more preferably 0.5 to 2.0 mol, per liter.

The effect of the present invention is remarkable when the amount of the ammonium salt is 0 to 50 molar % based on the whole counter cations in the bath having the fixing function in the present invention. Namely, the amount of ammonium ion is 0 to 50 molar %, preferably about 0 to 25 molar %, based on the whole ordinary counter cations including alkali metal, alkaline earth metal and ammonium ions.

Chemicals added to the bath having the fixing function are particularly preferably sodium and potassium salts such as sodium thiosulfate, potassium thiosulfate, sodium sulfite, potassium sulfite, sodium bisulfite, potassium bisulfite and potassium metabisulfite.

To improve the desilvering and image-keeping function, the processing solution of the present invention having the fixing function preferably contains a compound of the following general formula (IV):

general formula (IV)

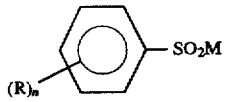

In the above formula, R represents a substituent of the benzene ring, and n represents an integer of 0 to 6. When n is 2 or larger, R's may be the same or different from each other. The substituents are preferably alkyl groups having 1 to 3 carbon atoms, substituted alkyl and alkoxy groups, hydroxyl group, nitro group, carboxylic acid groups, sulfonic acid groups, halogen atoms and phosphonic acid groups. The substituents of the alkali group are preferably hydroxyl group, carboxylic acid groups and sulfonic acid groups. M represents a hydrogen atom, alkali metal, alkaline earth metal, ammonium or amine.

Examples of the preferred compounds are given below, which by no means limit the compounds.

(IV-1)

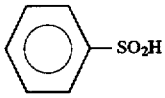

(IV-2)

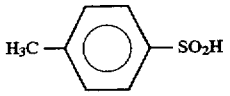

(IV-3)

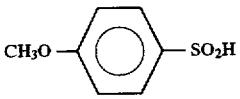

(IV-4)

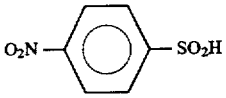

-continued (IV-5)

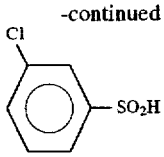

(IV-6)

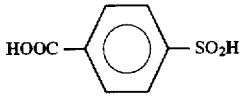

(IV-7)

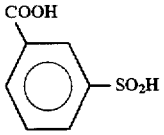

(IV-8)

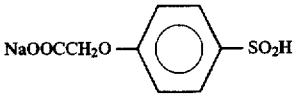

(IV-9)

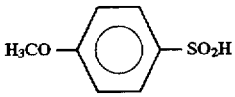

(IV-10)

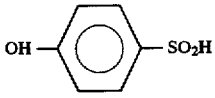

(IV-11)

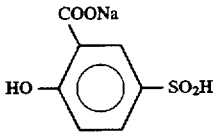

(IV-12)

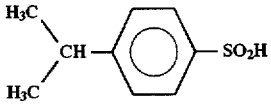

(IV-13)

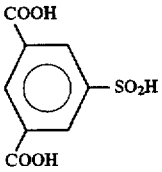

(IV-14)

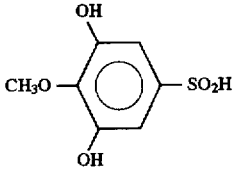

(IV-15)

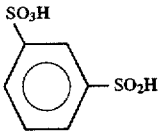

(IV-16)

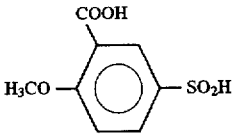

-continued (IV-17)

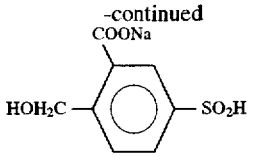

(IV-18)

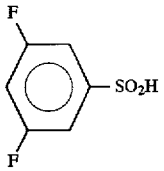

(IV-19)

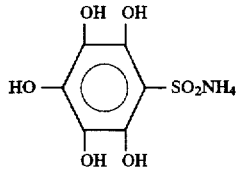

(IV-20)

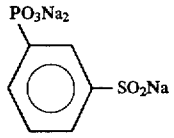

(IV-21)

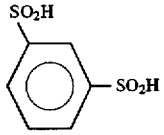

(IV-22)

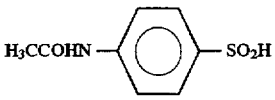

(IV-23)

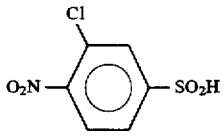

(IV-24)

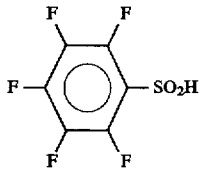

(IV-25)

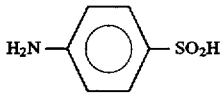

The amount of these compounds is 0.01 to 2 mol. preferably 0.05 to 1 mol. per liter of the processing solution.

The bleach-fixing solution and fixing solution of the present invention desirably contain a sulfite (or hydrogensulfite or metabisulfite) as the preservative particularly in an amount of 0.03 to 0.5 mol/l. more preferably 0.05 to 0.3 mol/l.

The bleach-fixing solution and fixing solution of the present invention contain the sulfite ion-releasing compounds, for example, the above-described sulfites (such as sodium sulfite, potassium sulfite and ammonium sulfite), bisulfites (such as ammonium bisulfite, sodium bisulfite and potassium bisulfite), metabisulfites (such as potassium metabisulfite, sodium metabisulfite and ammonium metabisulfite) as the preservative and, if necessary, aldehydes (such as benzaldehyde and acetaldehyde), ketones (such as acetone), ascorbic acids, hydroxylamines and alkylsulfinic acids.

The bleaching solution, bleach-fixing solution and fixing solution may contain, if necessary, a buffering agent, fluorescent brightener, chelating agent, defoaming agent, antifungal agent, etc.

The pH range of the bleaching solution, bleach-fixing solution and fixing solution is preferably 4 to 8, more preferably 4.5 to 6.5.

The amount of the replenisher for the bleaching solution, bleach-fixing solution and fixing solution used in the present invention is 50 to 2,000 ml per $m^2$ of the photosensitive material. Particularly when the amount of the replenisher for the bath having the fixing function is 100 to 550 ml, the effect of the present invention is remarkable. The term "amount of the replenisher" indicates that added per a unit area of the photosensitive material. When the replenisher is in the form of a powder or tablets, the amount of the replenisher is the total volume of water and solid replenisher. The washing water (postbath) or overflow from the stabilizing bath may be used as the replenisher, if necessary. The remarkable effect of the present invention can be obtained particularly when the iodine ion concentration of the bath having the fixing function is in the range of 0.003 to 0.03 mol/l, preferably 0.005 to 0.02 mol/l.

The processing temperature with the bleaching solution, bleach-fixing solution and fixing solution is 20° to 50° C., preferably 30° to 45° C. The processing period of time is 10 seconds to 3 minutes, preferably 20 seconds to 2 minutes.

In processing with a processing solution having a bleaching function, it is particularly preferred to conduct aeration so as to keep the photographic properties very stable. The aeration can be conducted by a method known in the art, such as blowing of air into the solution having the bleaching function or absorption of air with an ejector.

In the blowing of air, it is preferred to release air into the solution by means of a diffusing tube having fine pores. Such a type of diffusing tube is widely used for an aeration tank in the treatment of an activated sludge. In the aeration, techniques described on pages BL-1 to BL-2 of Z-121, Using Process C-41 (the third edition) published by Eastman Kodak Co. in 1982 can be employed. In the process of the present invention with the processing solution having bleaching function, vigorous stirring is preferred. For the stirring, contents of J. P. KOKAI No. Hei 3-33847 (from line 6, right upper column to line 2, left lower column on page 8) can be employed as they are.

In the desilverizing steps, the stirring is conducted preferably as vigorously as possible by, for example, a method which comprises bumping a jet of the processing solution against the emulsion surface of the photosensitive material as described in J. P. KOKAI No. Sho 62-183460; a method wherein the stirring effect is improved with a rotating means as described in J. P. KOKAI No. Sho 62-183461; a method wherein the photosensitive material is moved while the emulsion surface thereof is brought into contact with a wiper blade provided in the solution so as to make the flow on the emulsion surface turbulent and thereby improving the effect of the stirring; and a method wherein the quantity of the circulating flow of the whole processing solutions is increased. Such a means of making the stirring vigorous is effective for any of the bleaching solution, bleach-fixing solution and fixing solution. Supposedly, the improvement in the stirring effect accelerates the feeding of the bleaching agent and fixing agent into the emulsion membrane, thereby increasing the desilverizing speed. The above-described means of improving the stirring effect are more effective when a bleaching accelerator is used. In such a case, the acceleration effect is further improved and inhibition of the fixing by the bleaching accelerator can be controlled.

An automatic developing machine used for developing the photosensitive material of the present invention preferably has a means of transporting the photosensitive material as described in J. P. KOKAI Nos. Sho 60-191257, 60-191258 and 60-191259. As described in J. P. KOKAI No. Sho 60-191257, such a transportation means remarkably reduces the amount of the processing solution brought from the preceding bath into the subsequent bath, so that the deterioration in the function of the processing solution can be remarkably prevented. Such a function is particularly effective in reducing the processing time in each step and also in reducing the amount of the replenisher.

After the desilverization process, the photosensitive material of the present invention is usually washed with water and/or stabilized.

The amount of water used in the washing step varies in a wide range depending on the properties of the photosensitive material (which depend on, for example, couplers used), use thereof, temperature of water, number of the tanks (number of stages), replenishing method such as counter flow or down-flow system and various other conditions. The relationship between the number of the washing tanks and the amount of water in the multi-stage counter flow method can be determined by a method described in Journal of the Society of Motion Picture and Television Engineers, Vol. 64, p.p. 248 to 253 (May, 1955). Although the amount of water necessitated for washing can be remarkably reduced by the multi-stage counter flow method, another problem is caused in this method that bacteria propagate themselves while water is kept for a longer time in the tanks and, as a result, a suspended matter thus formed is attached to the photosensitive material. For solving this problem in the process of the present invention for processing the color photosensitive material, a very effective method for previously reducing the amount of calcium ion and magnesium ion described in J. P. KOKAI No. Sho 62-288,838 can be employed. Further, the water used for washing can contain isothiazolone compounds, thiabendazoles and chlorine-containing sterilizers such as sodium chloroisocyanurates described in J. P. KOKAI No. Sho 57-8,542, and benzotriazoles described in Hiroshi Horiguchi "Bokin Bobai-zai no Kagaku (Chemistry for Prevention of Bacteria and Fungi)" published by Sankyo Book Publishing Co. in 1986, "Biseibutsu no Mekkin, Sakkin, Bobai Gijutsu (Technique of Sterilization and Prevention of Microorganisms)" edited by Eisei Gijutsu-kai and published by Kogyo Gijutsu-kai in 1982 and "Bokinbobai-zai Jiten (Dictionary of Steriliers and Antifungal Agents)" edited by Nippon Bokinbobai Gakkai and published in 1986.

The pH of washing water for the photosensitive material in the present invention is 4 to 9, preferably 5 to 8. The temperature of the washing water and the washing time which vary depending on the properties and use of the photosensitive material are usually 15° to 45° C. and 20 seconds to 10 minutes, preferably 25° to 40° C. and 30 seconds to 5 minutes, respectively. The photosensitive material of the present invention can be processed directly with a stabilizing solution in place of the washing with water. The stabilization can be conducted by any of known processes described in J. P. KOKAI Nos. Sho 57- 8543, 58-14834 and 60-220345.

The stabilizing solution contains a compound which stabilizes the color image, selected from among, for example, formalin, benzaldehydes such as m-hydroxybenzaldehyde, formaldehyde/bisulfite adduct, hexamethylenetetramine and derivatives thereof, hexahydrotriazine and derivatives thereof, dimethylolurea, N-methylol compounds such as N-methylolpyrazole, organic acids and pH buffering agents. The preferred amount of these compounds is 0.001 to 0.02 mol per liter of the stabilizing solution. The free formaldehyde concentration in the stabilizing solution is preferably as low as possible so as to prevent formaldehyde gas from sublimation. From such a point of view as above, preferred color image stabilizers are m-hydroxybenzaldehyde, hexamethylenetetramine, N-methylolazoles described in J. P. KOKAI No. Hei 4-270344 such as N-methylolpyrazole and azolylmethylamines described in J. P. KOKAI No. Hei 4-313753 such as N,N'-bis(1,2,4-triazol-1-ylmethyl) piperazine. Particularly preferred is a combination of an azole such as 1,2,4-triazole with an azolylmethylamine such as 1,4-bis(1,2,4-triazol-1ylmethyl)piperazine or a derivative thereof as described in J. P. KOKAI No. Hei 4-359249 (corresponding to European Patent Unexamined Published Application No. 519190 A 2), since a high image stability and a low formaldehyde vapor pressure are realized by the combination. The stabilizing solution preferably contains, if necessary, an ammonium compound such as ammonium chloride or ammonium sulfite, a metal compound of Bi, Al or the like, a fluorescent whitening agent, a hardener, an alkanolamine described in U.S. Pat. No. 4,786,583, and a preservative which can be contained in also the above-described fixing solution and bleach-fixing solution such as a sulfinic acid compound described in J. P. KOKAI No. Hei 1-231051.

Various surfactants can be incorporated into washing water and/or stabilizing solution so as to prevent the formation of water spots in the course of drying of the photosensitive material. Among them, preferred is a nonionic surfactant, particularly an alkylphenol/ethylene oxide adduct. The alkylphenols are particularly preferably octyl-, nonyl-, dodecyl- and dinonylphenols. The molar number of ethylene oxide to be added is particularly preferably 8 to 14. It is also preferred to use a silicon surfactant having a high antifoaming effect.

The washing water and/or stabilizing solution preferably contain a chelating agent. Preferred chelating agents include aminopolycarboxylic acids such as ethylenediaminetetraacetic acid and diethylenetriaminepentaacetic acid; organic phosphonic acids such as 1-hydroxyethylidene-1,1-diphosphonic acid, N,N,N'-trimethylenephosphonic acid and diethylenetriamine-N,N,N',N'-tetramethylenephosphonic acid; and hydrolyzates of maleic anhydride polymers described in European Patent No. 345, 172 A 1.

The overflow obtained during the washing with water and/or replenishing of the stabilizing solution is reusable in other steps such as the desilverizing step.

When each of the above-described processing solutions is concentrated by evaporation in the process with an automatic developing machine, it is preferred to replenish a suitable amount of water, correcting solution or process replenisher in order to compensate the solution for concentration caused by the evaporation. Although the method for replenishing water is not particularly limited, preferred are the following methods: a method described in J. P. KOKAI Nos. Hei 1-254959 and 1-254960 wherein a monitor water tank which is different from the bleaching tank is provided, the amount of water evaporated from the monitor water tank is determined, the amount of water evaporated from the bleaching tank is calculated from the determined amount of evaporated water, and water is fed into the bleaching tank in proportion to the amount of evaporated water; and a method described in J. P. KOKAI Nos. Hei 3-248155, 3-249644, 3-249645 and 3-249646 wherein the compensation for the evaporation is conducted with a liquid level sensor or overflow sensor. Although water for compensating for the evaporation in each processing solution may be tap water, deionized water or sterilized water preferably used in the above-described water washing steps is preferred.

The detailed description will be made on the photosensitive material used in the present invention.

The phososensitive material used in the present invention preferably has a magnetic recording layer. The description will be made on the magnetic recording layer in the present invention.

The magnetic recording layer used in the present invention is prepared by applying an aqueous coating liquid or a coating liquid containing an organic solvent to a support, the coating liquid being prepared by dispersing magnetic particles in a binder.

The magnetic particles usable in the present invention include particles of ferromagnetic iron oxides such as $\gamma$—$Fe_2O_3$, Co-coated $\gamma$—$Fe_2O_3$, Co-coated magnetites, Co-containing magnetites, ferromagnetic chromium dioxide, ferromagnetic metals, ferromagnetic alloys, and hexagonal Ba ferrite, Sr ferrite, Pb ferrite and Ca ferrite. Among them, Co-coated ferromagnetic iron oxides such as Co-coated $\gamma$—$Fe_2O_3$ are preferred. The shape of them may be any of needles, rice grain-shape, spheres, cubes, plates, etc. The specific surface area is preferably at least 20 $m^2/g$ ($S_{BET}$), particularly preferably at least 30 $m^2/g$. The saturation magnetization ($\sigma s$) of the ferromagnetic substance is preferably $3.0\times10^4$ to $3.0\times10^5$ A/m, particularly preferably $4.0\times10^4$ to $2.5\times10^5$ A/m. The ferromagnetic particles may be surface-treated with silica and/or alumina or an organic material. The magnetic particles may be surface-treated also with a silane coupling agent or titanium coupling agent as described in J. P. KOKAI No. Hei 6-161032. Further, magnetic particles coated with an inorganic or organic substance as described in J. P. KOKAI Nos. Hei 4-259911 and 5-81652 are also usable.

The binders suitable for the magnetic particles include thermoplastic resins, thermosetting resins, radiation-curable resins, reactive resins, polymers decomposable with an acid or alkali, biodegradable polymers, natural polymers (such as cellulose derivatives, saccharide derivatives, etc.) and mixtures of them as described in J. P. KOKAI No. Hei 4-219569. These resins have a Tg of −40° to 300° C. and a weight-average molecular weight of 2,000 to 1,000,000. They include, for example, vinyl copolymers, cellyulose derivatives such as cellulose diacetate, cellulose triacetate, cellulose acetate propionate, cellulose acetate butyrate and cellulose tripropionate, acrylic resins and polyvinyl acetal resins. Gelatin is also preferred. Cellulose di(tri)acetate is particularly preferred. The binder can be cured with a crosslinking agent such as an epoxy, aziridine or isocyanate crosslinking agent. The isocyanate crosslinking agents include isocyanates such as tolylene diisocyanate, 4,4'-diphenylmethane diisocyanate, hexamethylene diisocyanate and xylilene diisocyanate; reaction products of such an isocyanate with a polyalcohol such as that obtained by reacting 3 mol of tolylene isocyanate with 1 mol of trimethylolpropane; and polyisocyanates obtained by the condensation of such an isocyanate. They are described in, for example, J. P. KOKAI No. Hei 6-59357.

The magnetic substance is dispersed in the binder by means of preferably a kneader, pin-type mill, annular mill or the like, or a combination of them is also preferred as described in J. P. KOKAI No. Hei 6-35092. Dispersants described in J. P. KOKAI No. Hei 5-088283 and other well-known dispersants are usable. The thickness of the magnetic recording layer is 0.1 to 10 μm, preferably 0.2 to 5 μm and more preferably 0.3 to 3 μm. The weight ratio of the magnetic particles to the binder is preferably 0.5:100 to 60:100, prepreferably 1:100 to 30:100. The amount of the magnetic particles used for coating is 0.005 to 3 $g/m^2$, preferably 0.01 to 2 $g/m^2$ and more preferably 0.02 to 0.5 $g/m^2$. The transmission yellow density of the magnetic recording layer is preferably 0.01 to 0.50, more preferably 0.03 to 0.20 and particularly preferably 0.04 to 0.15. The magnetic recording layer can be formed in stripes or over the whole surface of the back of the photographic support by coating or printing. The magnetic recording layer can be formed by, for example, air doctor coating, blade coating, air knife coating, squeeze coating, impregnation coating, reverse roll coating, transfer roll coating, gravure coating, kiss coating, cast coating, spray coating, dip coating, bar coating or extrudion coating method. The coating solutions described in J. P. KOKAI No. Hei 5-341436 or the like are preferred.

The magnetic recording layer may have also other functions such as lubricity-improving, curl-controlling, antistatic, adhesion-inhibiting and head-abrading functions or, alternatively, other functional layers may be formed to exhibit these functions. A preferred abrasive is such that at least one kind of the particles is aspherical inorganic particles having a Moh's scale of hardness of 5 or higher. The aspherical inorganic particles are preferably fine powders of oxides such as aluminum oxide, chromium oxide, silicon dioxide and titanium dioxide; carbides such as silicon carbide and titanium carbide; and diamond. These abrasives may be surface-treated with a silane coupling agent or titanium coupling agent. These particles may be added to the magnetic recording layer or, alternatively, the magnetic recording layer may be overcoated with them to form, for example, a protecting layer or lubricating layer. The binder to be used in this case may be that described above, preferably a binder for magnetic recording layers. The photosensitive materials having the magnetic recording layer are described in U.S. Pat. Nos. 5,336,589, 5,250,404, 5,229,259 and 5,215,874, and E.P. No. 466,130.

The photosensitive material of the present invention has at least one photosensitive layer formed on the support. A typical example of the photosensitive materials is a silver halide photographic material having at least one photosensitive layer (comprising two or more silver halide emulsion layers having substantially the same color sensitivity but different degree of sensitivity) formed on the support. The photosensitive layer is a unit photosensitive layer sensitive to any of blue, green and red lights. In the multi-layered silver halide color photosensitive materials, the arrangement of the unit photosensitive layers is as follows: a red-sensitive layer, a green-sensitive layer and a blue-sensitive layer in this order from the support. However, the order may be reversed or a sensitive layer may be interposed between two layers sensitive to another color depending on the purpose. A photoinsensitive layer can be provided between the silver halide photosensitive layers or as the top layer or the bottom layer. The layers may contain a coupler, DIR compound or color-mixing inhibitor as will be described below. The two or more silver halide emulsion layers constituting the unit photosensitive layers have preferably a structure consisting of two layers, i.e. a high sensitivity emulsion layer and a low sensitivity emulsion layer, as described in DE 1,121,470 or GB 923,045. The arrangement of the layers is usually preferably such that the sensitivity thereof decreases gradually toward the support. An emulsion layer having a low sensitivity may be formed away from the support and an emulsion layer having a high sensitivity may be formed close to the support as described in J.P. KOKAI Nos. Sho 57-112751, Sho 62-200350, Sho 62-206541 and Sho 62-206543.

An example of the arrangement is as follows: a blue-sensitive layer having a low sensitivity (BL)/blue-sensitive layer having a high sensitivity (BH)/green-sensitive layer having a high sensitivity (GH)/green-sensitive layer having a low sensitivity (GL)/red-sensitive layer having a high sensitivity (RH)/red-sensitive layer having a low sensitivity (RL); BH/BL/GL/GH/RH/RL; or BH/BL/GH/GL/RL/RH toward the support.

As described in J.P. KOKOKU No. Sho 55-34932, the arrangement may be a blue-sensitive layer/GH/RH/GL/RL toward the support. Another arrangement is a blue-sensitive layer/GL/RL/GH/RH toward the support as described in J.P. KOKAI Nos. Sho 56-25738 and Sho 62-63936.

Another arrangement is that of three layers having sensitivities gradually lowered toward the support, i.e. a top layer (a silver halide emulsion layer having the highest sensitivity), middle layer (a silver halide emulsion layer having a lower sensitivity) and bottom layer (a silver halide emulsion layer having a sensitivity lower than that of the middle layer) as described in J.P. KOKOKU No. 49-15495. Even in such an arrangement of the three layers having sensitivities different from each other, sensitive layers having the same-color sensitivity may comprise further an emulsion layer having a medium sensitivity/emulsion layer having a high sensitivity/emulsion layer having a low sensitivity in the order toward the support as described in J.P. KOKAI No. 59-202464.

In another example, the arrangement is as follows: high-sensitivity emulsion layer/low sensitivity emulsion layer/medium sensitivity emulsion layer, or low sensitivity emulsion layer/medium sensitivity emulsion layer/high sensitivity emulsion layer. When the photosensitive material has four or more layers, the arrangement of them may be varied as described above.

To improve the color reproducibility, it is preferred to arrange a donor layer (CL) having an interlayer effect and a spectral sensitivity distribution different from that of the main photosensitive layer such as BL, GL or RL adjacent to or close to the main photosensitive layer as described in U.S. Pat. Nos. 4,663,271, 4,705,744 and 4,707,436 and J.P. KOKAI Nos. Sho 62-160448 and Sho 63-89850.

The silver halides preferably used in the present invention include silver bromoiodide, silver chloroiodide, silver bromide, silver chlorobromide and silver chloride. Particularly preferred silver halide emulsion is a silver bromoiodide or silver chlorobromoiodide emulsion having a silver iodide content of about 2 to 10 mol, or an emulsion having a high silver chloride content of at least 90 molar %.

The silver halide grains in the photographic emulsion may be in a regular crystal form such as a cubic, octahedral or tetradecahedral form; an irregular crystal form such as spherical or plate form; or a complex crystal form thereof. They include also those having a crystal fault such as a twin plate.

The silver halide grain diameter may range from about 0.2 μm or less to as large as that having a projection area diameter of about 10 μm. The emulsion may be either a polydisperse emulsion or monodisperse emulsion.

The silver halide photographic emulsion usable in the present invention can be prepared by processes described in, for example, Research Disclosure (hereinafter referred to as "RD"), No. 17643 (December, 1978), pp. 22 to 23, "1. Emulsion preparation and types" ; RD No. 18716 (November, 1979), p. 648; RD No. 307105 (November, 1989), pp. 863 to 865; P. Glafkides, Chemie et Phisique Photographique, Paul Montel, 1967; G. F. Duffin, Photographic Emulsion Chemistry (Focal Press, 1966); V. L. Zelikman et al., Making and Coating Photographic Emulsion (Focal Press, 1964).

Monodisperse emulsions described in U.S. Pat. Nos. 3,574,628 and 3,655,394 and G. B. Pat. No. 1,413,748 are also preferred.

Tabular grains having an aspect ratio of 3 or higher are also usable. The tabular grains can be easily prepared by processes described in, for example, Gutoff, Photographic Science and Engineering, Vol. 14, pp. 248 to 257 (1970); U.S. Pat. Nos. 4,434,226, 4,414,310, 4,433,048 and 4,439,520; and G. B. Pat. No. 2,112,157.

The crystal structure of the grains in the above emulsion may be uniform; the grains may comprise an inside portion and an outside portion which are composed of silver halides different from each other; or the structure may be a laminated one. Different silver halide grains can be bonded together by an epitaxial bond or they can be bonded with a compound other than silver halides such as silver rhodanate or lead oxide. A mixture of grains having various crystal forms can also be used.

The emulsion may be of a surface-latent image type for forming a latent image mainly on the surface thereof, of an internal latent image type for forming a latent image in the grains or of such a type that a latent image is formed both on the surface and in the grains. The emulsion must be a negative one. In the internal latent image type emulsions, a core/shell type internal latent image type emulsion described in J.P. KOKAI No. Sho 63-264740 may also be used. Processes for producing such a kind of emulsion are described in J. P. KOKAI No. Sho 59-133542. The thickness of the shells in the emulsion which varies depending on the developing process is preferably 3 to 40 nm, particularly preferably 5 to 20 nm.

The silver halide emulsion to be used in the present invention is usually physically and chemically ripened and spectrally sensitized. The additives to be used in these steps are shown in RD Nos. 17643, 18716 and 307105. The portions in which the additives are mentioned in these three Research Disclosures are summarized in a table given below.

A mixture of two or more photosensitive silver halide emulsions different from one another in at least one of grain size, grain size distribution, halogen components, shape of the grains and sensitivity can be used for forming a layer.

Silver halide grains having the fogged surface described in U.S. Pat. No. 4,082,553, silver halide grains having fogged core and colloidal silver described in U.S. Pat. No. 4,626,498 and J.P. KOKAI No. Sho 59-214852 are preferably used for forming the photosensitive silver halide emulsion layer and/or substantially photo-insensitive, hydrophilic colloid layer. The term "silver halide grains having fogged core or surface" indicates silver halide grains which can be subjected to uniform (non-imagewise) development irrespective of exposed or non-exposed parts of the photosensitive material. Processes for producing them are described in U.S. Pat. No. 4,626,498 and J. P. KOKAI No. 59-214852. The silver halide for forming the core of the core/shell type silver halide grains having the fogged core may have the same or different halogen composition. The silver halides having the fogged core or surface include silver chloride, silver chlorobromide, silver bromoiodide and silver chlorobromoiodide. The average size of the fogged silver halide grains is preferably 0.01 to 0.75 μm, particularly 0.05 to 0.6 μm. The grains may be regular or in the form of a polydisperse emulsion. The dispersion is preferably of monodisperse system wherein at least 95% (by weight or by number of the grains) of the silver halide grains have a grain diameter within the average grain diameter ±40%.

Fine grains of a photo-insensitive silver halide are preferably used in the present invention. The term "fine grains of photo-insensitive silver halide" indicates fine silver halide grains which are not sensitized in the image-forming exposure for forming a dye image and which are substantially not developed in the developing process. They are preferably previously not fogged. The fine silver halide grains have a silver bromide content of 0 to 100 molar %. If necessary, they may contain silver chloride and/or silver iodide. They preferably contain 0.5 to 10 molar % of silver iodide. The fine silver halide grains have an average grain diameter (average diameter of a projected area) of preferably 0.01 to 0.5 μm, more preferably 0.02 to 0.2 μm.

The fine silver halide grains can be prepared by the same processes as those for the production of ordinary photosensitive silver halides. It is unnecessary to chemically sensitize or spectrally sensitize the surface of the silver halide grains. It is preferred, however, to incorporate a known stabilizer such as a triazole, azaindene, benzothiazolium or mercapto compound or a zinc compound thereinto prior to the incorporation thereof into a coating solution. Colloidal silica can be preferably incorporated into the fine silver halide grain-containing layer.

The amount of silver to be applied to the photosensitive material used in the present invention is preferably not larger than 6.0 g/m$^2$, most preferably not larger than 4.5 g/m$^2$.

Photographic additives usable in the present invention are also mentioned in RD, and the corresponding portions are also shown in the following table.

| Additive | RD 17643 | RD 18716 | RD 307105 |
|---|---|---|---|
| 1. Chemical sensitizer | p. 23 | p. 648, right column | p. 866 |
| 2. Sensitivity improver | | ditto | |
| 3. Spectral sensitizer and supersensitizer | pp. 23 to 24 | p. 648, right column to p. 649, right column | pp. 866 to 868 |
| 4. Brightening agent | p. 24 | p. 647, right column | p. 868 |
| 5. Light absorber, filter, dye and UV absorber | pp. 25 to 26 | p. 649, right column to p. 650, left column | p. 873 |
| 6. Binder | p. 26 | p. 651, left column | pp. 873 to 874 |
| 7. Plasticizer and lubricant | p. 27 | p. 650, right column | p. 876 |
| 8. Coating aid and surfactant | pp. 26 and 27 | ditto | pp. 875 to 876 |
| 9. Antistatic agent | p. 27 | ditto | pp. 876 to 877 |
| 10. Matting agent | | | pp. 878 to 879 |

The photosensitive material of the present invention can contain various dye-forming couplers. Among them, the following couplers are particularly preferred:

Yellow couplers: couplers represented by formulae (I) and (II) in E.P. No. 502,424A; those of formulae (1) and (2) in E.P. No. 513,496A (particularly Y-28 on page 18); those of general formula (I) in claim 1 of E.P. No. 568,037A; those of general formula (I) in lines 45 to 55, column 1 of U.S. Pat. No. 5,066,576; those of general formula (I) in paragraph 0008 of J. P. KOKAI No. Hei 4-274425; those set forth in claim 1, on p. 40 of E. P. No. 498,381A1 (particularly D-35 on p. 18); those of formula (Y) on p. 4 of E. P. No. 447,969A1 (particularly Y-1 on p. 17 and Y-54 on p. 41); and those of general formulae (II) to (IV) in lines 36 to 58, column 7 of U.S. Pat. No. 4,476,219 (particularly II-17, 19 (column 17) and II-24 (column 19)].

Magenta couplers: those described in J. P. KOKAI No. Hei 3-39737 [L-57 (right lower column, p. 11), L-68 (right lower column, p. 12) and L-77 (right lower column, p. 13) [A-4]-63 (p. 134), [A-4]-73 and 75 (p. 139) in E. P. No. 456,257; M-4 and 6 (p. 26) in E. P. No. 486,965; M-45 (p. 19) in EP 571,959A; M-1 (p. 6) in J. P. KOKAI No. Hei 5-204106; and M-22 in J. P. KOKAI No. Hei 4-362631.

Cyan couplers: CX-1, 3, 4, 5, 11, 12, 14 and 15 (pp. 14 to 16) of J.P. KOKAI No. Hei 4-204843; C-7 and 10 (p. 35), 34 and 35 (p. 37), (I-1) and (I-17) (pp. 42 to 43) of J. P. KOKAI No. Hei 4-43345; and those of general formula (Ia) or (Ib) in claim 1 of J. P. KOKAI No. Hei 6-67385, and Polymer couplers: P-1 and P-5 (p. 11) of J.P. KOKAI No. Hei 2-44345.

The couplers capable of forming a colored dye having a suitable diffusibility are preferably those described in U.S. Pat. No. 4,366,237, G.B. Patent No. 2,125,570, E. P. No. 96,873B and DE P. No. 3,234,533.

The couplers used for compensation for unnecessary absorption of the colored dye are preferably as follows: yellow-colored cyan couplers of formulae (CI), (CII), (CIII) and (CIV) on p. 5 of E. P. No. 456,257A1 (particularly YC-86 on p. 84); yellow-colored magenta coupler ExM-7 (p. 202), EX-1 (p. 249) and EX-7 (p. 251) described in E. P. No. 456,257A1; magenta-colored cyan couplers CC-9 (column 8) and CC-13 (column 10) described in U.S. Pat. No. 4,833,069; couplers (2) (column 8) in U.S. Pat. No. 4,837,136; and colorless masking couplers of formula (A) in claim 1 of WO 92/11575 (particularly compounds given on pages 36 to 45).

Compounds (including couplers) capable of reacting with an oxidation product of the developing agent to form a photographically useful compound residue are as follows: development inhibitor-releasing compounds such as compounds of formulae (I), (II), (III) and (IV) on page 11 of E. P. No. 378,236A1 [particularly compounds T-101 (p. 30), T-104 (p. 31), T-113 (p. 36), T-131 (p. 45), T-144 (p. 51) and T-158(p. 58)], compounds of formula (I) on page 7 of E. P. No. 436,938A2 [particularly D-49 (p. 51)], compounds of formula (1) in EP 568,037A [particularly (23) on p. 11)], compounds of formulae (I), (II) and (III) on pages 5 to 6 of E. P. No. 440,195A2 [particularly I-(1) on page 29]; bleaching accelerator-releasing compounds such as compounds of formulae (I) and (I') on page 5 of E. P. No. 310,125A2 [particularly (60) and (61) on p. 61] and compounds of formula (I) in claim 1 of J. P. KOKAI No. Hei 6-59411 [particularly (7) on p. 7]; ligand-releasing compounds such as those of LIG-X in claim 1 of U.S. Pat. No. 4,555,478 (particularly compounds in lines 21 to 41 in column 12); leuco dye-releasing compounds such as compounds 1 to 6 in columns 3 to 8 of U.S. Pat. No. 4,749,641; fluorescent dye-releasing compounds such as compounds represented by COUP-DYE in claim 1 of U.S. Pat. No. 4,774,181 (particularly compounds 1 to 11 in columns 7 to 10); development accelerator- or fogging agent-releasing compounds such as those of formulae (1), (2) and (3) in U.S. Pat.

No. 4,656,123 [particularly (I-22) in column 25)] and ExZK-2 in lines 36 to 38 on page 75 of E. P. No. 450,637A2; compounds which do not release a dye-forming group before coupling-off such as compounds of formula (I) in claim 1 of U.S. Pat. No. 4,857,447 (particularly Y-1 to Y-19 in columns 25 to 36).

As additives other than the couplers, those described below are preferred.

Dispersion media for oil-soluble organic compounds: P-3, 5, 16, 19, 25, 30, 42, 49, 54, 55, 66, 81, 85, 86 and 93 (pp. 140 to 144) described in J. P. KOKAI No. Sho 62-215272; latices for impregnation of oil-soluble organic compounds: latices described in U.S. Pat. No. 4,199,363; oxidized developing agent scavengers: compounds of formula (I) in lines 54 to 62, column 2 of U.S. Pat. No. 4,978,606 [particularly I-(1), (2), (6) and (12) in columns 4 and 5] and those of formulae in lines 5 to 10, column 2 of U.S. Pat. No. 4,923,787 [particularly compound 1 (column 3)]; antistaining agents: those of formulae (I) to (III) in lines 30 to 33, p. 4 of E. P. No. 298,321A, particularly I-47, 72, III-1 and 27 (pp. 24 to 48); discoloration inhibitors: A-6, 7, 20, 21, 23, 24, 25, 26, 30, 37, 40, 42, 48, 63, 90, 92, 94 and 164 of E. P. No. 298,321A (pp. 69 to 118), II-1 to III-23 in columns 25 to 38 of U.S. Pat. No. 5,122,444, particularly III-10, I-1 to III-4 on pp. 8 to 12 of E. P. No. 471,347A, particularly II-2, and A-1 to 48 in columns 32 to 40 of U.S. Pat. No. 5,139,931, particularly A-39 and 42; materials capable of reducing the amount of the coupling improver or color mixing-inhibitor used: I-1 to II-15 on pp. 5 to 24 of E. P. No. 411,324A, particularly I-46; formalin scavengers: SCV-1 to 28 on pp. 24 to 29 of E. P. No. 477,932A, particularly SCV-8; hardeners: H-1, 4, 6, 8 and 14 on p. 17 of J. P. KOKAI No. Hei 1-214845, and compounds (H-1 to 54) of formulae (VII) to (XII) in columns 13 to 23 of U.S. Pat. No. 4,618,573, compounds (H-1 to 76) of formula (6) in the right, lower column on p. 8 of J. P. KOKAI No. Hei 2-214852, particularly H-14, and compounds set forth in claim 1 of U.S. Pat. No. 3,325,287; development inhibitor precursors: P-24, 37 and 39 (pp. 6 and 7) of J. P. KOKAI No. Sho 62-168139; and compounds set forth in claim 1 of U.S. Pat. No. 5,019,492, particularly 28 and 29 in column 7; antiseptics and mildew-proofing agents: I-1 to III-43 in columns 3 to 15 of U.S. Pat. No. 4,923,790, particularly II-1, 9, 10 and 18 and III-25; stabilizers and antifoggants: I-1 to (14) in columns 6 to 16 of U.S. Pat. No. 4,923,793, particularly I-1, 60, (2) and (13), and compounds 1 to 65 in columns 25 to 32 of U.S. Pat. No. 4,952,483, particularly 36; chemical sensitizers: triphenylphosphine selenide and compound 50 of J. P. KOKAI No. Hei 5-40324; dyes: a-1 to b-20 on pp. 15 to 18 of J. P. KOKAI No. Hei 3-156450, particularly a-1, 12, 18, 27, 35, 36 and b-5, V-1 to 23 on pp. 27 to 29, particularly V-1, F-I-1 to F-II-43 on pp. 33 to 55 of E. P. No. 445,627A, particularly F-I-11 and F-II-8, III-1 to 36, on pp. 17 to 28 of E. P. No. 457,153A, particularly III-1 and 3, fine crystal dispersions of Dye-1 to 124 on pp. 8 to 26 of WO88/04794, compounds 1 to 22 on pp. 6 to 11 of E. P. No. 319,999A, particularly compound 1, compounds D-1 to 87 of formulae (1) to (3) (pp. 3 to 28) of E. P. No. 519,306A, compounds 1 to 22 (columns 3 to 10) of formula (I) in U.S. Pat. No. 4,268,622, and compounds (1) to (31) of formula (I) (columns 2 to 9) of U.S. Pat. No. 4,923,788; and UV absorbers: compounds (18b) to (18r) of formula (1) and 101 to 427 (pp. 6 to 9) of J. P. KOKAI No. 46-3335, compounds (3) to (66) (pp. 10 to 44) of formula (I), compounds HBT-1 to 10 (p. 14) of formula (III) of E. P. No. 520,938A, and compounds (1) to (31) of formula (1) (columns 2 to 9) of E. P. No. 521,823A.

The present invention is applicable to various color photosensitive materials such as ordinary color negative films, cinema color negative films, reversal color films for slides or televisions, color papers, positive color films and reversal color papers. The invention is applicable particularly preferably to the color negative films and color papers. The invention is suitable also for a film unit having a lens described in J. P. KOKOKU No. Hei 2-32615 and Japanese Utility Model Publication for Opposition Purpose No. Hei 3-39784.

The supports suitable for use in the present invention are described, for example, on page 28 of the above-described RD No. 17643; from right column, page 647 to left column, page 648 of RD 18716; and on page 879 of RD 307105. Polyester supports are preferably used.

Now, the description is made on the polyester supports used in the present invention. The details of the supports including the photosensitive materials, process, cartridge and examples of them are described in Kokaigiho No. 94-6023 [Hatsumei Kyokai (Japan Institute of Invention and Innovation); Mar. 15, 1994]. The polyesters used in the present invention are obtained from a diol and an aromatic dicarboxylic acid as the indispensable components. The aromatic dicarboxylic acids include 2,6-, 1,5-, 1,4- and 2,7-naphthalenedicarboxylic acids, terephthalic acid, isophthalic acid and phthalic acid. The diols include diethylene glycol, triethylene glycol, cyclohexanedimethanol, bisphenol A and bisphenol. The polymers include homopolymers such as polyethylene terephthalate, polyethylene naphthalate and polycyclohexanedimethanol terephthalate. Particularly preferred polymers are polyesters containing 50 to 100 molar % of 2,6-naphthalenedicarboxylic acid. Polyethylene 2,6-naphthalate is particularly preferred. The average molecular weight is in the range of about 5,000 to 200,000. Tg of the polyesters of the present invention is not below 50° C., preferably not below 90° C.

The polyester support is heat-treated at a temperature of not below 40° C., preferably in the range of Tg-20° C. to below Tg, so as to prevent it from curling. The heat treatment may be carried out at a given temperature within the above-described range or under cooling. The heat treatment time is 0.1 to 1500 hours, preferably 0.5 to 200 hours. The support may be heat-treated in the form of a roll or while it is transported in the form of a web. The surface of the support may be improved by making it rough by, for example, applying conductive inorganic fine particles such as $SnO_2$ or $Sb_2O_5$. Ideas, such as an idea that an end of the support may be knurled so as to make the end slightly higher, thereby preventing transfer of the shape of cutting portion on the core to the photographic material, are desirable. The heat treatment can be conducted after the formation of the support, after the surface treatment, after the application of the back layer (antistatic agent, lubricant or the like) or after the formation of the subbing layer. The heat treatment is conducted preferably after the application of an antistatic agent.

An ultraviolet absorber may be kneaded into the polyester. The object can be attained by kneading a dye or pigment, available on the market for the polyesters, such as Diaresin (a product of Mitsubishi Chemical Industries Ltd.) or Kayaset (a product of Nippon Kayaku Co., Ltd.) into the polyester.

Then, the surface treatment is preferred for adhering the support to the photosensitive layers. The surface treatment is conducted by a surface-activating treatment such as chemical treatment, mechanical treatment, corona discharge treatment, flame treatment, ultraviolet treatment, high-frequency treatment, glow discharge treatment, active plasma treatment, laser treatment, mixed acid treatment or ozone oxidation treatment. In them, the ultraviolet radiation treatment, flame treatment, corona treatment or glow treatment is preferred.

The description is made on the subbing layer. The subbing layer may comprise single or plural layers. Binders for the subbing layer include copolymers produced from monomers selected from among vinyl chloride, vinylidene chloride, butadiene, methacrylic acid, acrylic acid, itaconic agcid and maleic anhydride; and polyethyleneimine, epoxy resin, grafted gelatin, nitrocellulose and gelatine. Compounds for swelling the support include resorcin and p-chlorophenol. The gelatin-hardeners in the subbing layer include chromium salts (such as chromium alum), aldehydes (such as formaldehyde and glutaraldehyde), isocyanates, active halogen compounds (such as 2,4-dichloro-6-hydroxy-S-triazine), epichlorohydrin resin, active vinyl sulfone compounds, etc. Further, the subbing layer may contain $SiO_2$, $TiO_2$, inorganic fine particles or fine particles (0.01 to 10 μm) of a polymethyl methacrylate copolymer.

An antistatic agent is preferably used in the present invention. The antistatic agents include high-molecular, cationic high-molecular and ionic surfactant compounds including carboxylic acids, carboxylic acid salts and sulfonic acd salts.

The most preferred antistatic agents are crystalline metal oxides, having a volume resistivity of not above $10^7$ Ω·cm, preferably not above $10^5$ Ω·cm, and a particle size of 0.001 to 1.0 μm, selected from among ZnO, $TiO_2$, $SnO_2$, $Al_2O_3$, $SiO_2$, MgO, BaO, $MoO_3$ and $V_2O_5$; fine particles of composite oxides of them (such as Sb, P, B, In, S, Si and C); metal oxides in sol form; or fine particles of composite oxide of them. The amount of the antistatic agent in the photosensitive material is preferably 5 to 500 mg/m$^2$, particularly preferably 10 to 350 mg/m$^2$. The ratio of the conductive crystalline oxide or its composite oxide to the binder is preferably 1/300 to 100/1, more preferably 1/100 to 100/5.

The photosensitive material of the present invention preferably has sliding properties. A layer containing a sliding agent is preferably used on photosensitive layer surface and the back surface. The preferred sliding property corresponds to a kinetic friction coefficient of 0.01 to 0.25. The kinetic friction coefficient is determined with a stainless steel ball having a diameter of 5 mm at 60 cm/min (25° C., 60% RH). When the mating material is replaced with the photosensitive layer surface, a value substantially on the same level is obtained.

The sliding agents usable in the present invention include polyorganosiloxanes, higher fatty acid amides, higher fatty acid metal salts and higher fatty acid/higher alcohol esters. The polyorganosiloxanes usable herein include polydimethylsiloxane, polydiethylsiloxane, polystyrylmethylsiloxane and polymethylphenylsiloxane. Added layers are preferably the outermost emulsion layer and back layer. Polydimethylsiloxane and esters having a long-chain alkyl group are particularly preferred.

The photosensitive material used in the present invention referably contains a matting agent. Although the matting agent may be contained in an emulsion layer or back surface layer, it is particularly preferably contained in the outermost emulsion layer. The matting agent may be either soluble or insoluble in the processing solutions. A combination of a matting agent soluble in the processing solutions with that insoluble therein is preferably used. The matting agent is preferably polymethyl methacrylate, poly(methyl methacrylate/methacrylic acid=9/1 or 5/5 molar ratio) or polystyrene particles. The particle size is preferably 0.8 to 10 μm, and the particle size distribution is preferably in a narrow range. Preferably at least 90% of the total particles have a particle size in the range of 0.9 to 1.1 times as large as the average particle size. Further, it is preferred to use also fine particles having a size of 0.8 μm or below so as to improve the matting properties. They include, for example, polymethyl methacrylate (0.2 μm), poly(methyl methacrylate/methacrylic acid=9/1 molar ratio) (0.3 μm), polystyrene particles (0.25 μm) and colloidal silica (0.03 μm).

Now, the description will be made on film cartridges used in the present invention. The main materials for the cartridges used in the present invention may be metals or synthetic plastics.

Preferred plastic materials include, for example, polystyrene, polyethylene, polypropylene and polyphenyl ether. The cartridges used in the present invention may contain various antistatic agents. They preferably contain carbon black, metal oxide particles, a nonionic, anionic, cationic or betaine surfactant or a polymer. The cartridges thus made antistatic are described in J. P. KOKAI Nos. Hei 1-312537 and 1-312538. Particularly those having a resistance of $10^{12}$Ω or below at 25° C. and 25% RH are preferred. Usually plastic cartridges are produced from a plastic containing carbon black and a pigment kneaded therein for the purpose of shading. The cartridges may have a size of 135 which is common at present or, for reducing the size thereof, the diameter of the 135-size cartridge which is now 25 mm may be reduced to 22 mm or smaller. The capacity of the case of the cartridge is not larger than 30 cm$^3$, preferably not larger than 25 cm$^3$. The amount of the plastic used for forming the cartridge and cartridge case is preferably 5 to 15 g.

The cartridges used in the present invention may have such a structure that a spool is rotated to feed the film; or the structure thereof may be such that an end of the film is kept in the body of the cartridge and when the spool shaft is rotated in the film-feeding direction, the end of the film is sent outward through the port of the cartridge. These structures are disclosed in U.S. Pat. Nos. 4,834,306 and 5,226,613. The photographic films used in the present invention may be so-called raw stocks prior to the development or the developed photographic films. Both raw stock and developed film may be kept in either the same new cartridge or different cartridges.

The photosensitive material of the present invention has a total thickness of the hydrophilic colloidal layers on the emulsion layer-side of 28 μm or below, preferably 23 μm or below, more preferably 18 μm or below and particularly 16 μm or below. The film-swelling rate $T_{1/2}$ is preferably 30 sec or below, more preferably 20 sec or below. $T_{1/2}$ is defined to be the time required for attaining the thickness of a half (½) of the saturated film thickness, the saturated film thickness being 90% of the maximum thickness of the film swollen with the color developer at 30° C. for 3 minutes and 15 seconds. The thickness is determined at 25° C. and at a relative humidity of 55% (2 days). The film-swelling rate $T_{1/2}$ can be determined with a swellometer described on pages 124 to 129 of A. Green et al., "Photogr. Sci. Eng.", Vol. 19, No. 2. $T_{1/2}$ can be controlled by adding a hardener to gelatin used as the binder or by varying the time conditions after the coating. The swelling rate is preferably 150 to 400%. The swelling rate is calculated according to the following formula:

$$[(\text{maximum swollen film thickness})-(\text{film thickness})]/(\text{film thickness})$$

wherein the maximum swollen film thickness is determined under the above-described conditions.

The photosensitive material used in the present invention preferably has a hydrophilic colloid layer (in other words, back layer) having total thickness of 2 to 20 μm on dry basis on the opposite side to the emulsion layer. The back layer preferably contains the above-described light absorber, filter dye, ultraviolet absorber, antistatic agent, hardener, binder, plasticizer, lubricant, coating aid and surfactant. The swelling rate of the back layer is preferably 150 to 500%.

The following Examples will further illustrate the present invention, which by no means limit the invention.

EXAMPLE 1

(1) Materials for the support

The supports used in the Examples were prepared by the following methods:

PEN: 100 parts by weight of commercially available poly(ethylene-2,6-naphthalate) and 2 parts by weight of Tinuvin P. 326 (a product of Geigy) were dried by an ordinary method and then molten at 300° C. The melt was extruded through a T-shaped die and the product was longitudinally stretched to 3.3-fold length at 140° C. and then transversely stretched to 3.3-fold at 130° C. The product was set by heat at 250° C. for 6 seconds. The glass transition temperature of the product was 120° C.

TAC: Triacetylcellulose was produced by an ordinary solution casting method and Band method using a solution of a methylene chloride/methanol ratio of 82/8, TAC concentration of 13% and plasticizer TPP/BDP of 2/1 (TPP being triphenyl phosphate and BDP being biphenyl diphenyl phosphate).

A sample prepared with the heat-treated PEN will be referred to as "Sample 101" and that prepared with PEN not heat-treated will be referred to as "Sample 103". A sample prepared with TAC will be referred to as "Sample 102".

(2) Formation of subbing layer

Both surfaces of each of the above-described supports were processed by corona discharge treatment. Then a subbing solution having a composition given below was applied to the surface to form the subbing layer on one side to be exposed to a high temperature in the stretching step. The corona discharge treatment was conducted with a 6 KVA model of a solid state corona treatment machine manufactured by Pillar. The support having a width of 30 cm was treated at a rate of 20 m/min. From the readings of the electric current and voltage, it was found that the processing strength was 0.375 KV·A·min/m$^2$. The discharge frequency in the process was 9.6 KHz, and the gap clearance between the electrode and the dielectric roll was 1.6 mm.

| | |
|---|---|
| Gelatin | 3 g |
| Distilled water | 250 ml |
| Sodium α-sulfodi-2-ethylhexyl succinate | 0.05 g |
| Formaldehyde | 0.02 g |

A subbing layer having the following composition was formed on the support TAC.

| | |
|---|---|
| Gelatin | 0.2 g |
| Salicylic acid | 0.1 g |
| Methanol | 15 ml |
| Acetone | 85 ml |
| Formaldehyde | 0.01 g |

(3) Formation of back layers

The first back layer to the third back layer as will be described below were formed by coating one side of the subbed support prepared in the above-described step (2):

A) The first back layer:

| | |
|---|---|
| Fine powder of Co-containing needle-shaped γ-iron oxide (in the form of dispersion in gelatin; average particle diameter: 0.08 μm) | 0.2 g/m$^2$ |
| Gelatin | 3 g/m$^2$ |
| Compound of formula 27 given below | 0.1 g/m$^2$ |
| Compound of formula 28 given below | 0.02 g/m$^2$ |
| Poly(ethyl acrylate) (average particle diameter: 0.08 μm) | 1 g/m$^2$ |

$(CH_2{=}CHSO_2NHCH_2CH_2NH)_2CO$

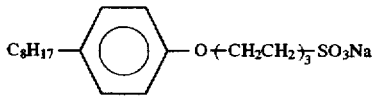

B) The second back layer:

| | |
|---|---|
| Gelatin | 0.05 g/m$^2$ |
| Conductive material [$SnO_2/Sb_2O_3$ (9:1), particle diameter: 0.15 μm) | 0.16 g/m$^2$ |
| Sodium dodecylbenzenesulfonate | 0.05 g/m$^2$ |

C) The third back layer:

| | |
|---|---|
| Gelatin | 0.5 g/m$^2$ |
| Polymethyl methacrylate (average particle diameter: 1.5 μm) | 0.02 g/m$^2$ |
| Cetyl stearate (dispersed in sodium dodecylbenzenesulfonate) | 0.01 g/m$^2$ |
| Sodium di(2-ethylhexyl)sulfosuccinate | 0.01 g/m$^2$ |
| Compound of formula 29 given below | 0.01 g/m$^2$ |

$C_8F_{17}SO_2N(C_3H_7)(CH_2CH_2O)_4(CH_2)_4SO_3Na$

The back layers thus obtained had a coercive force of 960 Oe.

(4) Heat treatment of support

After the formation of the subbing layer and back layer on the support followed by drying and rolling, the product was heat-treated at 110° C. for 48 hours.

A photosensitive layer shown in the following step (5) was formed on the two kinds of supports prepared as described above to obtain the photosensitive materials. The photosensitive material having the PEN support will be referred to as "Sample 101" and that having the TAC support will be "Sample 102". A sample having the PEN support and not subjected to the heat treatment (4) will be referred to as "Sample 103".

(5) Production of photosensitive layers

The main materials used for forming the layers are as follows:

ExC: cyan coupler,

ExM: magenta coupler,

ExY: yellow coupler,

ExS: sensitized dye,

UV: ultraviolet absorber,

HBS: high boiling organic solvent, and

H: gelatin hardener.

The numerals for the respective components indicate the amounts (g/m$^2$) of the coatings, and those for silver halides are given in terms of silver. The amount of the sensitizing dye is given in terms of mol per mol of the silver halide contained in the same layer.

| | | |
|---|---|---|
| The first layer (antihalation layer) | | |
| Black colloidal silver | silver | 0.09 |
| Gelatin | | 1.60 |
| ExM-1 | | 0.12 |
| ExF-1 | | $2.0 \times 10^{-3}$ |
| Solid dispersed dye ExF-2 | | 0.030 |
| Solid dispersed dye ExF-3 | | 0.040 |
| HBS-1 | | 0.15 |
| HBS-2 | | 0.02 |
| The second layer (intermediate layer) | | |
| Silver bromoiodide emulsion M | silver | 0.065 |
| ExC-2 | | 0.04 |
| Polyethyl acrylate latex | | 0.20 |
| Gelatin | | 1.04 |
| The third layer (slow-speed red-sensitive emulsion layer) | | |
| Silver bromoiodide emulsion A | silver | 0.25 |
| Silver bromoiodide emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| The fourth layer (medium-speed red-sensitive emulsion layer) | | |
| Silver bromoiodide emulsion C | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| The fifth layer (high-speed red-sensitive emulsion layer) | | |
| Silver bromoiodide emulsion D | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| The sixth layer (intermediate layer) | | |
| Cpd-1 | | 0.090 |
| Solid dispersed dye ExF-4 | | 0.030 |
| HBS-1 | | 0.050 |
| Polyethyl acrylate latex | | 0.15 |
| Gelatin | | 1.10 |
| The seventh layer (low-speed green-sensitive emulsion layer) | | |
| Silver bromoiodide emulsion E | silver | 0.15 |
| Silver bromoiodide emulsion F | silver | 0.10 |
| Silver bromoiodide emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |

-continued

| | | |
|---|---|---|
| ExY-1 | | 0.015 |
| HBS-1 | | 0.30 |
| HBS-3 | | 0.010 |
| Gelatin | | 0.73 |
| The eighth layer (medium-speed green-sensitive emulsion layer) | | |
| Silver bromoiodide emulsion H | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| The ninth layer (high-speed green-sensitive emulsion layer) | | |
| Silver bromoiodide emulsion I | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethyl acrylate latex | | 0.15 |
| Gelatin | | 1.33 |
| The tenth layer (yellow filter layer) | | |
| Yellow colloidal silver | silver | 0.015 |
| Cpd-1 | | 0.16 |
| Solid dispersed dye ExF-5 | | 0.060 |
| Solid dispersed dye ExF-6 | | 0.060 |
| Oil-soluble dye ExF-7 | | 0.010 |
| HBS-1 | | 0.60 |
| Gelatin | | 0.60 |
| The eleventh layer (low-speed blue-sensitive emulsion layer) | | |
| Silver bromoiodide emulsion J | silver | 0.09 |
| Silver bromoiodide emulsion K | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| The twelfth layer (high-speed blue-sensitive emulsion layer) | | |
| Silver bromoiodide emulsion L | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| The thirteenth layer (the first protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| The fourteenth layer (the second protective layer) | | |
| Silver bromoiodide emulsion M | silver | 0.10 |
| H-1 | | 0.40 |
| B-1 (diameter: 1.7 μm) | | $5.0 \times 10^{-2}$ |

-continued

| | |
|---|---|
| B-2 (diameter: 1.7 μm) | 0.15 |
| B-3 | 0.05 |
| S-1 | 0.20 |
| Gelatin | 0.70 |

These layers suitably contain W-1 to W-3, B-4 to B-6, F-1 to F-17, iron salts, lead salts, gold salts, platinum salts, palladium salts, iridium salts and rhodium salts in order to improve the storability, processability, pressure resistance, antifungal and antimicrobial properties, antistatic properties and coatability.

TABLE 1

| Emulsion | Average AgI content (%) | Coefficient of variation of AgI content of grains (%) | Average grain diameter (diameter of corresponding spheres (μm) |
|---|---|---|---|
| A | 1.7 | 10 | 0.46 |
| B | 3.5 | 15 | 0.57 |
| C | 8.9 | 25 | 0.66 |
| D | 8.9 | 18 | 0.84 |
| E | 1.7 | 10 | 0.46 |
| F | 3.5 | 15 | 0.57 |
| G | 8.8 | 25 | 0.61 |
| H | 8.8 | 25 | 0.61 |
| I | 8.9 | 18 | 0.84 |
| J | 1.7 | 10 | 0.46 |
| K | 8.8 | 18 | 0.64 |
| L | 14.0 | 25 | 1.28 |
| M | 1.0 | — | 0.07 |

| Emulsion | Coefficient of variation of grain diameter (%) | Diameter of projected area (diameter of corresponding circle (μm) | Diameter/thickness ratio |
|---|---|---|---|
| A | 15 | 0.56 | 5.5 |
| B | 20 | 0.78 | 4.0 |
| C | 25 | 0.87 | 5.8 |
| D | 26 | 1.03 | 3.7 |
| E | 15 | 0.56 | 5.5 |
| F | 20 | 0.78 | 4.0 |
| G | 23 | 0.77 | 4.4 |
| H | 23 | 0.77 | 4.4 |
| I | 26 | 1.03 | 3.7 |
| J | 15 | 0.50 | 4.2 |
| K | 23 | 0.85 | 5.2 |
| L | 26 | 1.46 | 3.5 |
| M | 15 | — | 1 |

In Table 1:

(1) The emulsions J to L were reduction-sensitized with thiourea dioxide and thiosulfonic acid in the step of preparation of the grains as described in an Example of J. P. KOKAI No. 2-191938.

(2) The emulsions A to I were sensitized by gold sensitization, sulfur sensitization and selenium sensitization methods in the presence of a spectral sensitizing dye mentioned above for each photosensitive layer and sodium thiocyanate as described in an Example of J. P. KOKAI No. Hei 3-237450.

(3) In the preparation of tabular grains, a low-molecular weight gelatin was used as described in an Example of J. P. KOKAI No. Hei 1-158426.

(4) Dislocation lines as described in J. P. KOKAI No. Hei 3-237450 are obserbed on the tabular grains with a high-voltage electron microscope.

(5) The emulsion L had double structure grains each having an internal high-iodine core as described n J. P. KOKAI No. Sho 60-143331.

Preparation of dispersion of organic solid disperse dye

ExF-2 which will be described below was dispersed as follows: 21.7 ml of water, 3 ml of 5% aqueous solution of sodium p-octylphenoxyethoxyethoxyethanesulfonate and 0.5 g of 5% aqueous solution of p-octylphenoxy polyoxyethylene ether (degree of polymerization: 10) were fed into a 700 ml pot mill. 5.0 g of dye ExF-2 and 500 ml of zirconium oxide beads (diameter: 1 mm) were added thereto, and the dispersion of the contents was conducted for 2 hours. For the dispersion, a BO type vibration ball mill (a product of Chuo Koki) was used. After the completion of the dispersion, the obtained dispersion was taken out and added to 8 g of 12.5% aqueous gelatin solution. The beads were removed by filtration to obtain a dispersion of the dye in gelatin. The average diameter of the fine dye grains was 0.44 μm.

A solid dispersion of each of ExF-3, ExF-4 and ExF-6 was obtained in the same manner as that described above. The average grain diameters of the fine dye grains were 0.24 μm, 0.45 μm and 0.52 μm, respectively. ExF-5 was dispersed by a microprecipitation dispersion method described in Example 1 in European Patent Application Kokai (EP) No. 549,489 A. The average grain diameter was 0.06 μm.

ExC-1

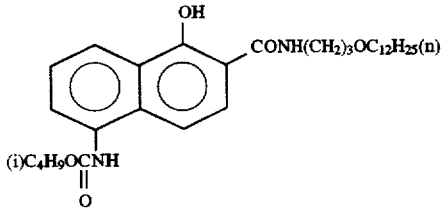

-continued
ExC-2
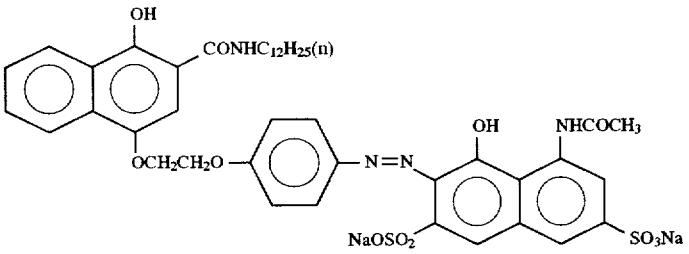
ExC-3
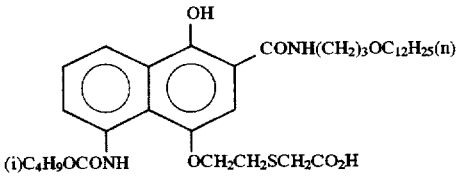
ExC-4
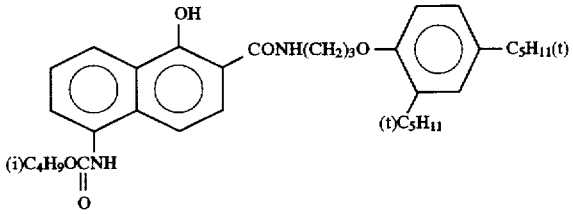
ExC-5
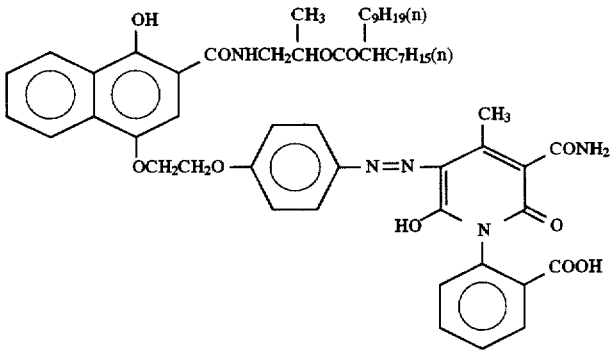
ExC-6
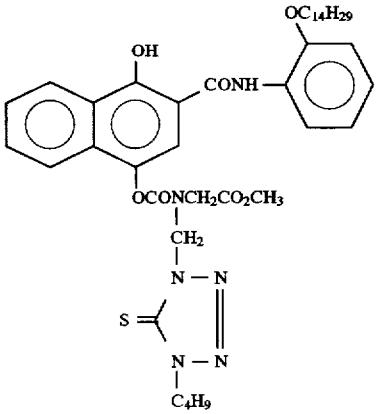
ExC-7
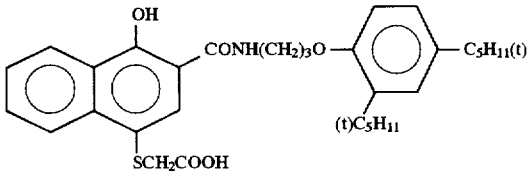

-continued
ExC-8
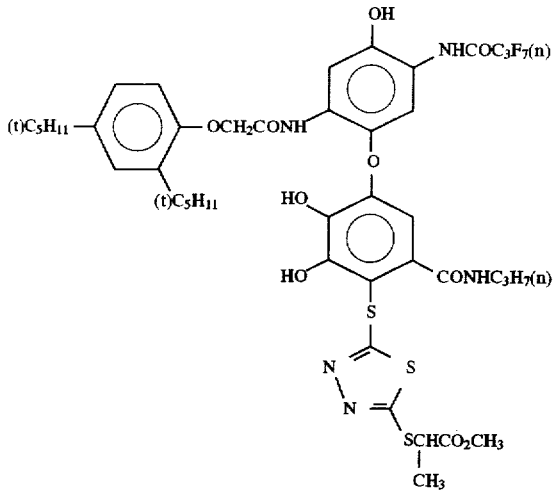
ExM-1
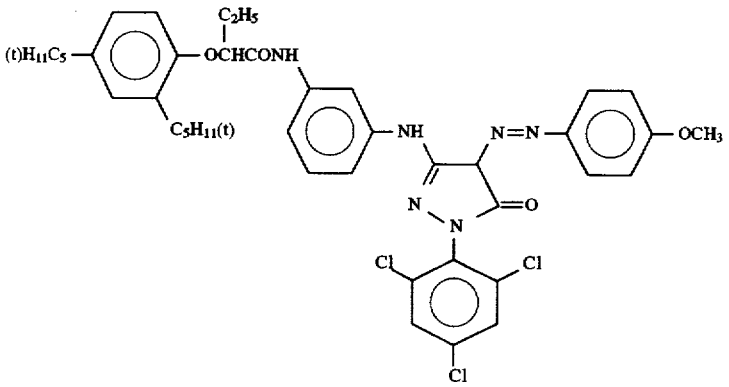
ExM-2
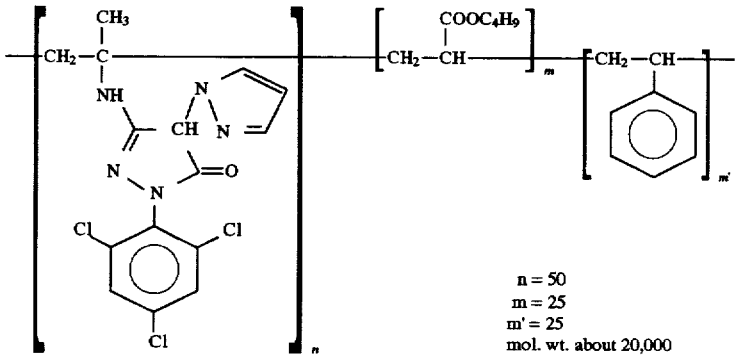
ExM-3
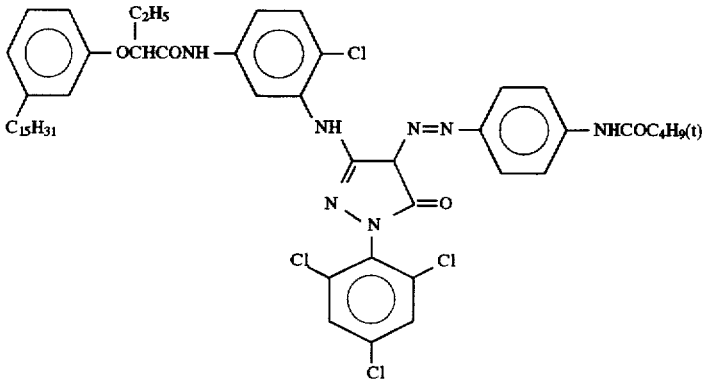

-continued
ExM-4
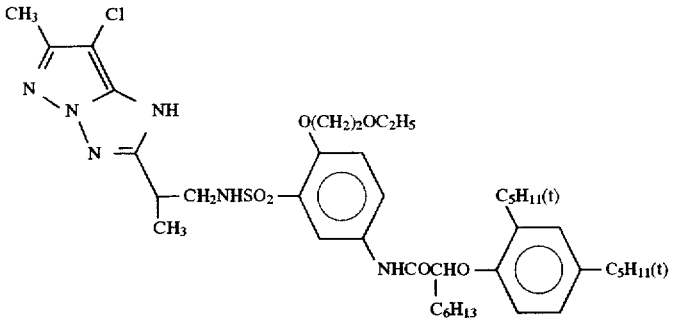
ExM-5
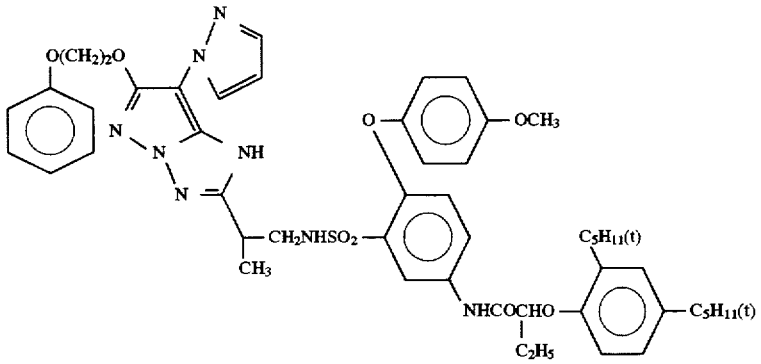
ExY-1
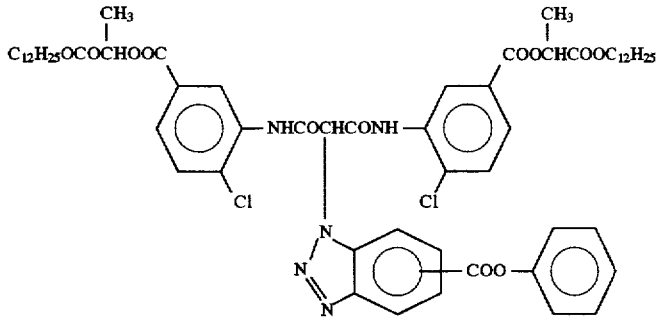
ExY-2
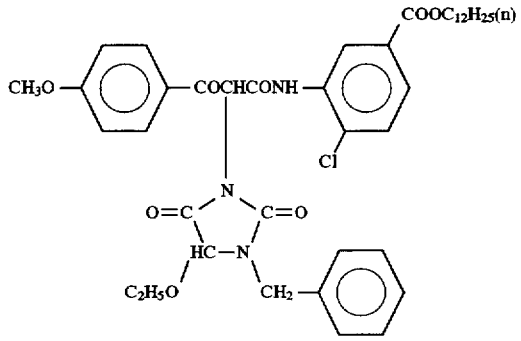

-continued
ExY-3
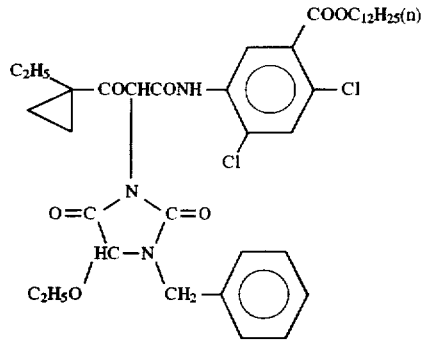
ExY-4
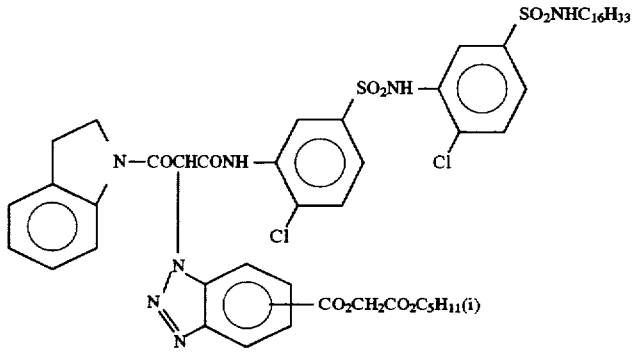
ExY-5
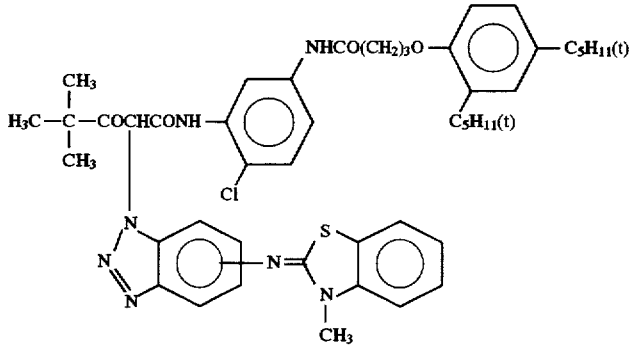
ExF-1
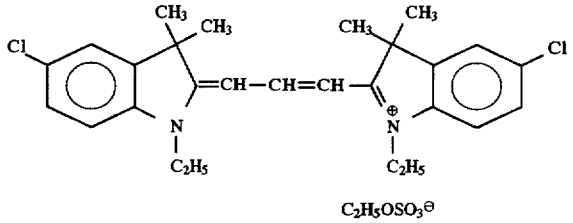
ExF-2
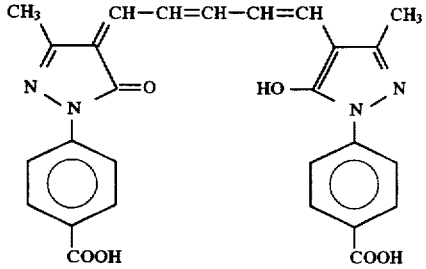

-continued
ExF-3
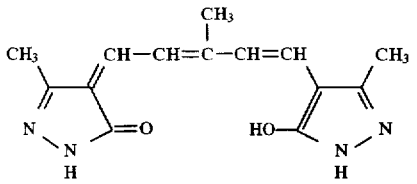
ExF-4
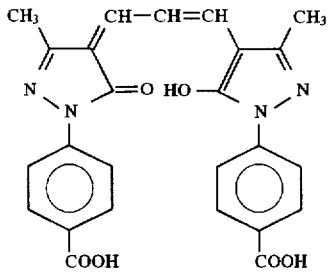
ExF-5
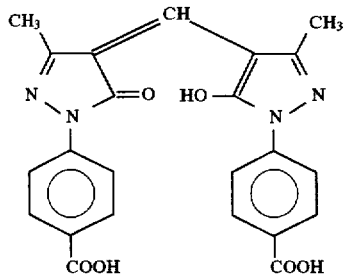
ExF-6
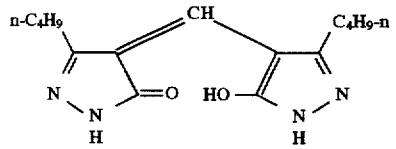
ExF-7
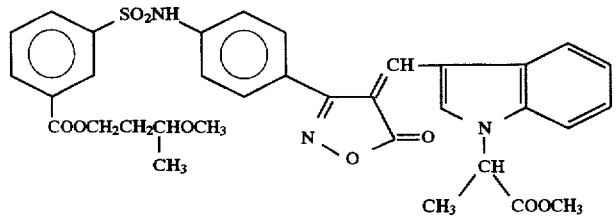
Cpd-1
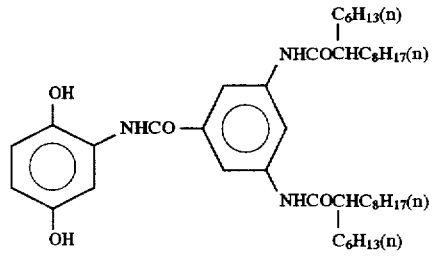
Cpd-2
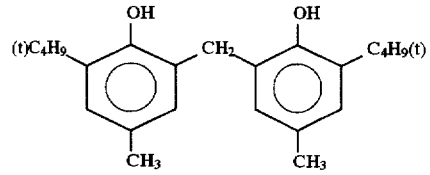

-continued
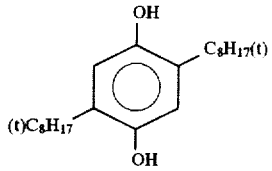
Cpd-3
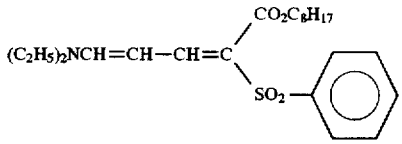
UV-1
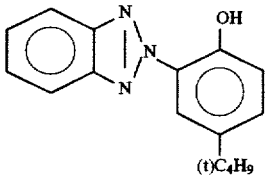
UV-2
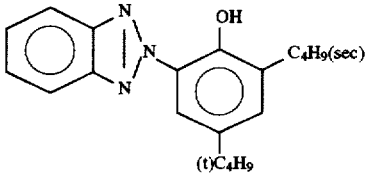
UV-3
Tricresylphosphate HBS-1
Di-n-butylphthalate HBS-2
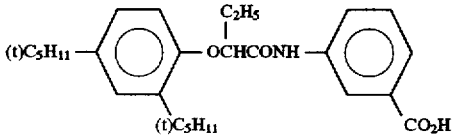
HBS-3
Tri(2-ethylhexyl)phosphate HBS-4
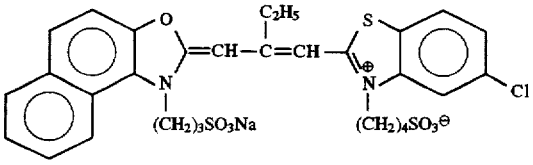
ExS-1
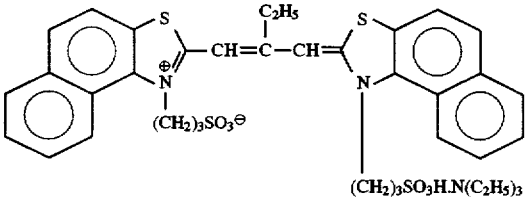
ExS-2
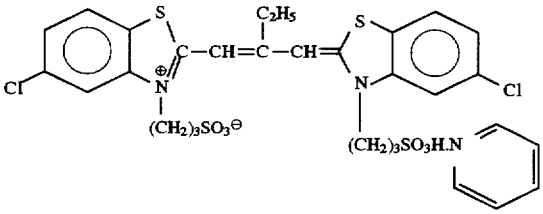
ExS-3

-continued
ExS-4
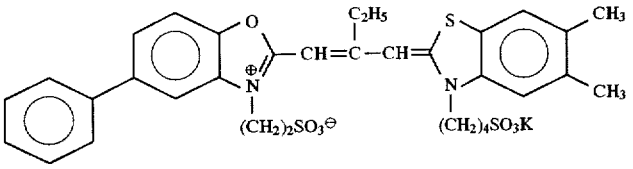
ExS-5
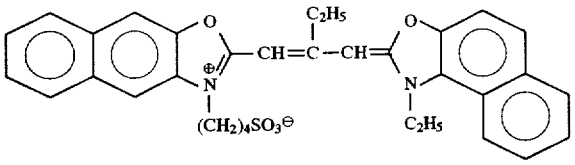
ExS-6
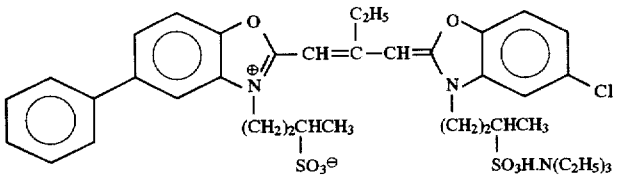
ExS-7
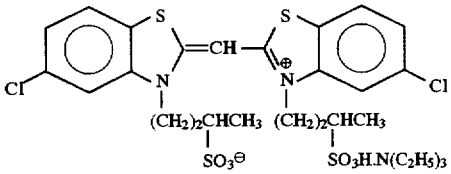
S-1
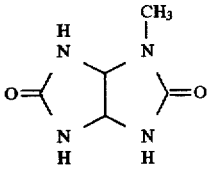
H-1
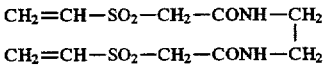
B-1
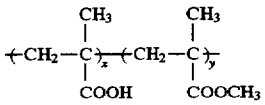
x/y = 10/90
B-2
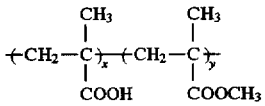
x/y = 40/60
B-3
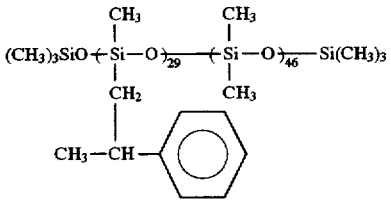
B-4
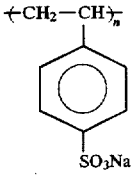

-continued
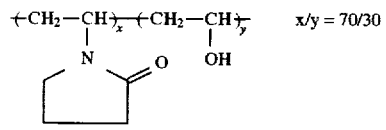
x/y = 70/30 B-5
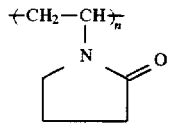
(mol. wt. about 10,000) B-6
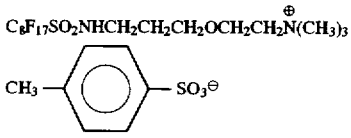
W-1
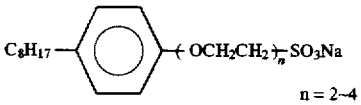
n = 2~4 W-2
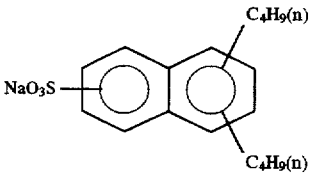
W-3
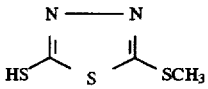
F-1
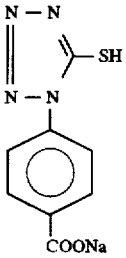
F-2
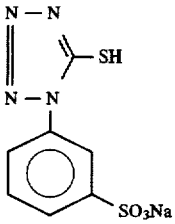
F-3
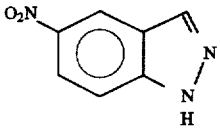
F-4
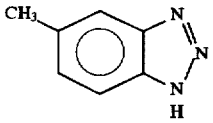
F-5
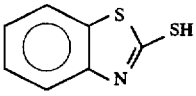
F-6

-continued

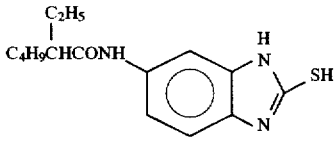

F-7

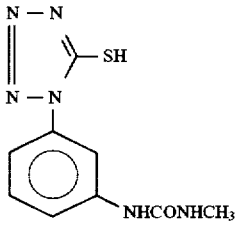

F-8

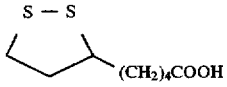

F-9

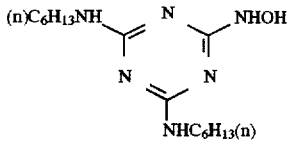

F-10

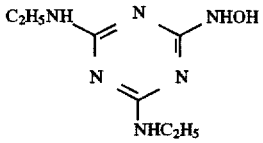

F-11

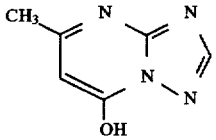

F-12

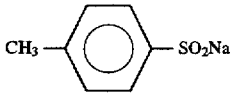

F-13

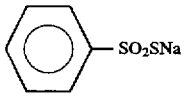

F-14

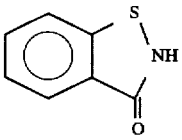

F-15

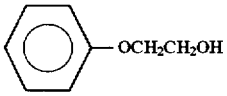

F-16

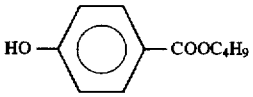

F-17

The photosensitive material prepared as described above was cut into pieces having a width of 24 mm and length of 160 cm. Each piece was perforated to form two holes 2 mm across at an interval of 5.8 mm at one longitudinal end of the photosensitive material and 0.7 mm distant from the transverse edge therof. The set of two holes was provided repeatedly at intervals of 32 mm. The photosensitive material was fitted in a film cartridge made form a plastic and shown in FIGS. 1 through 7 in U.S. Pat. No. 5,296,887.

FM signals were recorded on the sample thus prepared at a rate a 100 mm/s between the perforations in the photosensitive material with a head with which the input and output (head gap: 5 μm, turn number: 2,000) from the coated surface side of the magnetic recording layer were possible.

After the completion of the recording of the FM signals, the whole emulsion surface was uniformly exposed to a light of 1,000 cms and processed by methods described below. Then the film was fitted again in the film cartridge made from the plastic.

Then the film was taken out and the signals were read at the speed same as the speed of recording the signals with the head so as to check whether the correct output was possible or not. The ratio of the error-causing bit number to the input bit number is given in Tables 2 and 3. An error rate of 0.01% or below is practically permissible, and that of 0.1% or above is impermissible.

The quantity of silver remaining in the photosensitive material and the minimum yellow density were determined by a method described below after completion of the process. The results are also given in Tables 2 and 3.

Method for determination of the quantity of remaining silver: The quantity of silver remaining in the photosensitive material after 1,000 cms gray exposure was determined by the fluorescent X-ray analysis.

Method for determination of minimum density: It was determined with a Macbeth Densitometer.

The details of the process were as described below.

After the gray exposure (20 cms) through a wedge at a color temperature of 4800 K, the above-described sample was processed with the following processing solutions in the following processing steps by using a processing machine for motion picture film. The concentrations of the thiosulfate, additives and bleaching agent were changed as shown in Tables 2 and 3, and the process was conducted with each of them.

(Processing steps)

| Processing steps | Temp. | Time |
|---|---|---|
| Color development | 38° C. | 3 minutes 15 seconds |
| Bleaching | 38° C. | 60 seconds |
| Fixing | 38° C. | 120 seconds |
| Stabilization (1) | 38° C. | 20 seconds |
| Stabilization (2) | 38° C. | 20 seconds |
| Stabilization (3) | 38° C. | 20 seconds |
| Drying | 60° C. | 60 seconds |

[The stabilization was conducted by counter-current method from (3) to (1) with three tanks.]

The compositions of the processing solutions were as follows:

| (Color developer) | | (unit: g) Mother solution |
|---|---|---|
| Diethylenetriaminepentaacetic acid | | 4.0 |
| Disodium 4,5-dihydroxybenzene-1,3-disulfonate | | 0.5 |
| Sodium sulfite | | 4.0 |
| Potassium carbonate | | 38.0 |
| Potassium bromide | | 4.0 |
| Potassium iodide | | 1.3 mg |
| Hydroxylamine sulfate | | 2.4 |
| N,N-(Disulfonatoethyl)hydroxylamine | | 4.5 |
| 2-Methyl-4-[N-ethyl-N-(β-hydroxyethyl)amino]aniline sulfate | | 5.0 |
| Water | ad | 1.0 l |
| pH (adjusted with potassium hydroxide and sulfuric acid) | | 10.05 |

-continued

| (Bleaching solution) | | (unit: g) Mother solution |
|---|---|---|
| Ferric ammonium 1,3-diaminopropanetetraacetate monohydrate | | 150.0 |
| 1,3-Diaminopropanetetraacetic acid | | 3.0 |
| Ammonium bromide | | 100.0 |
| Ammonium nitrate | | 17.0 |
| Ammonia water (27%) | | 10.0 |
| Acetic acid (98%) | | 50.0 |
| Potassium carbonate | | 10.0 |
| Water | ad | 1.0 l |
| pH (adjusted with ammonia water and acetic acid) | | 4.3 |

| (Fixing solution) | | (unit: g) |
|---|---|---|
| Disodium ethylenediaminetetraacetate | | 1.7 |
| Sodium sulfite | | 16.0 |
| Sodium bisulfite | | 11.0 |
| Potassium thiosulfate | | See Table 2 |
| Compound of general formula (I) or (II) | | See Table 2 |
| Potassium iodide | | 1.0 |
| Silver bromide | | 5.0 |
| Water | ad | 1.0 l |
| pH | | 6.5 |

| (Stabilizer) | | (unit: g) |
|---|---|---|
| Surfactant [$S_{10}H_{21}$—O—$(CH_2CH_2O)_{10}$—H] | | 1.0 |
| Polymaleic acid (average molecular weight: 2000) | | 1.0 |
| 1,2-Benzisothiazoline-3-on | | 0.05 |
| Water | ad | 1.0 l |
| pH | | 8.5 |

The process was conducted with each of the fixing solutions having varied compositions.

The results of the quantitative determination of remaining silver, the minimum yellow density and the accuracy in reading the magnetic recording are given in Table 2.

TABLE 2

| | Fixing agent | | |
|---|---|---|---|
| No. | Total $S_2O_3^{2-}$ (mol/l) | Compound (I) (II) (mol/l) | Ratio |
| 01 | — | I-2 1.5 | 1.0 |
| 02 | 1.0 | ditto 0.5 | 0.500 |
| 03 | 1.3 | ditto 0.2 | 0.153 |
| 04 | 1.4 | ditto 0.1 | 0.071 |
| 05 | 1.5 | — | 0 |
| 06 | — | I-5 1.5 | 1.0 |
| 07 | 1.0 | ditto 0.5 | 0.50 |
| 08 | 1.2 | ditto 0.3 | 0.25 |
| 09 | 1.4 | ditto 0.1 | 0.071 |
| 10 | — | II-3 1.5 | 1.0 |
| 11 | 1.3 | ditto 0.2 | 0.153 |
| 12 | 1.4 | ditto 0.1 | 0.071 |
| 13 | — | II-12 1.5 | 1.0 |
| 14 | 1.0 | ditto 0.5 | 0.50 |
| 15 | 1.2 | ditto 0.3 | 0.25 |
| 16 | 1.4 | ditto 0.1 | 0.071 |

| | Sample 101 | | | |
|---|---|---|---|---|
| No. | Error rate (%) | Quantity of silver* | DBmin | Remarks |
| 01 | 0.11 | 98 | 0.85 | Comp. Ex. |
| 02 | 0.01 | 9.2 | 0.76 | Present invention |
| 03 | 0.005 | 3.4 | 0.73 | ditto |
| 04 | 0.004 | 3.8 | 0.73 | ditto |
| 05 | 0.15 | 119 | 0.89 | Comp. Ex. |
| 06 | 0.14 | 89 | 0.83 | Present invention |

TABLE 2-continued

| | | | | |
|---|---|---|---|---|
| 07 | 0.011 | 9.9 | 0.77 | ditto |
| 08 | 0.005 | 4.2 | 0.73 | ditto |
| 09 | 0.005 | 3.6 | 0.73 | ditto |
| 10 | 0.18 | 81 | 0.82 | Comp. Ex. |
| 11 | 0.005 | 3.4 | 0.74 | Present invention |
| 12 | 0.005 | 4.5 | 0.74 | ditto |
| 13 | 0.15 | 77 | 0.82 | Comp. Ex. |
| 14 | 0.010 | 11.0 | 0.76 | Present invention |
| 15 | 0.005 | 4.5 | 0.73 | ditto |
| 16 | 0.007 | 4.1 | 0.73 | ditto |

*Quantity of remaining silver: $\mu g/cm^2$.

It is apparent from the results given in Table 2 that in the present invention, excellent desilverization was attained, the yellow stain is reduced and the accuracy in reading the magnetic recording was improved, thought the ammonium salt-free fixing agent was used and the desilverization time was short. Particularly, the solutions containing the thiosulfate and the compound of the general formula (I) or (II) of the present invention in a ratio in the range of 0.02/1 to 0.30/1 exhibited the most excellent results.

EXAMPLE 2

The same samples 102 and 103 as those used in Example 1 were processed with fixing solutions Nos. 01 to 05 in Table 2 in Example 1, and the error rate was determined in the same manner as that described above to obtain the results shown in Table 3.

TABLE 3

| | Fixing agent | | |
|---|---|---|---|
| No. | ATS (mol/l) | Compound (I) (II) (mol/l) | Ratio |
| 17 | — | I-2 1.5 | 1.0 |
| 18 | 1.0 | ditto 0.5 | 0.500 |
| 19 | 1.3 | ditto 0.2 | 0.153 |
| 20 | 1.4 | ditto 0.1 | 0.071 |
| 21 | 1.5 | — | 0 |

| | Error rate | | | |
|---|---|---|---|---|
| No. | 101 | 102 | 103 | Remarks |
| 17 | 0.11 | 0.011 | 0.011 | Comp. Ex. |
| 18 | 0.01 | 0.012 | 0.012 | Present invention |
| 19 | 0.005 | 0.009 | 0.008 | ditto |
| 20 | 0.004 | 0.007 | 0.007 | ditto |
| 21 | 0.15 | 0.015 | 0.016 | Comp. Ex. |

It is apparent from the results shown in Table 3 that when the heat-treated PEN support was used (sample 101), the most excellent results were obtained.

EXAMPLE 3

The procedure as that of Example 1 was repeated except that I-2 in the fixing solution No. 3 was replaced with an equimolar amount of I-1, I-4, I-6, I-12, I-20, II-1, II-11, II-14, II-20, II-75 or II-79 to obtain excellent results.

EXAMPLE 4

The Sample 101 prepared as described in Example 1 was continuously processed (running test), after the image-wise exposure, until the replenisher in an amount of twice as much as the color development tank capacity had been fed. The following recipe A, B or C of the bleach-fixing bath was used, and the amount of the replenisher was altered as shown in Table 4. The running test was conducted with each of them. The processing steps were as shown below.

| | (Processing steps) | | |
|---|---|---|---|
| Processing step | Temp. | Time | Amount of replenisher* |
| Color development | 45° C. | 90 sec | 260 |
| Bleach-fixing | 40° C. | 120 sec | see Table 4 |
| Stabilization (1) | 40° C. | 15 sec | — |
| Stabilization (2) | 40° C. | 15 sec | — |
| Stabilization (3) | 40° C. | 15 sec | 390 |
| Drying | 75° C. | 30 sec | — |

[The washing was conducted by counter-current method from tank (3) to tank (1) by using the three tanks.]
*per $m^2$ (ml).

The amount of the carry-over from the preceding bath was 60 ml per square meter of the photosensitive material.

The composition of each of the processing solutions was as follows:

| | (unit: g) | |
|---|---|---|
| (Color developer) | mother solution | Replenisher |
| Diethylenetriaminepentaacetic acid | 4.0 | 4.0 |
| Disodium 4,5-dihydroxybenzene-1,3-disulfonate | 0.5 | 0.5 |
| Sodium sulfite | 4.0 | 8.0 |
| Potassium carbonate | 38.0 | 38.0 |
| Potassium bromide | 4.0 | — |
| Potassium iodide | 1.3 mg | — |
| N,N-(Disulfonatoethyl)hydroxylamine | 5.0 | 10.0 |
| 2-Methyl-4-[N-ethyl-N-(β-hydroxyethyl)-amino]aniline sulfate | 10.0 | 22.0 |
| Water ad | 1.0 l | 1.0 l |
| pH (adjusted with potassium hydroxide and sulfuric acid) | 10.05 | 10.40 |

| | (unit: g) | |
|---|---|---|
| (Bleach-fixing solution A) (Comparative Example) | mother solution | Replenisher |
| Ethylenediamine-(2-carboxyphenyl)-N,N',N'-triacetic acid | 0.10 mol | 0.12 mol |
| Ethylenediaminetetraacetic acid | 0.06 mol | 0.08 mol |
| Ferric chloride | 0.16 mol | 0.18 mol |
| Sodium thiosulfate | 1.5 mol | 1.6 mol |
| Sodium iodide | 1.0 | — |
| Potassium sulfite | 10.0 | 40.0 |
| Sodium succinate | 12.0 | 12.0 |
| Water ad | 1.0 l | 1.0 l |
| pH (adjusted with nitric acid and KOH) | 5.5 | 5.0 |

| | (unit: g) | |
|---|---|---|
| (Bleach-fixing solution B) (Comparative Example) | mother solution | Replenisher |
| Ethylenediamine-(2-carboxyphenyl)-N,N',N'-triacetic acid | 0.10 mol | 0.12 mol |
| Ethylenediaminetetraacetic acid | 0.06 mol | 0.08 mol |
| Ferric chloride | 0.16 mol | 0.18 mol |
| Compound I-2 | 1.5 mol | 1.6 mol |
| Sodium iodide | 1.0 | — |
| Potassium sulfite | 10.0 | 40.0 |
| Sodium succinate | 12.0 | 12.0 |
| Water ad | 1.0 l | 1.0 l |
| pH (adjusted with nitric acid and KOH) | 5.5 | 5.0 |

-continued

| (Bleach-fixing solution C) (present invention) | (unit: g) mother solution | Replenisher |
|---|---|---|
| Ethylenediamine-(2-carboxyphenyl)-N,N', N'-triacetic acid | 0.10 mol | 0.12 mol |
| Ethylenediaminetetraacetic acid | 0.06 mol | 0.08 mol |
| Ferric chloride | 0.16 mol | 0.18 mol |
| Compound I-2 | 0.25 mol | 0.30 mol |
| Sodium thiosulfate | 1.25 | 1.30 |
| Sodium iodide | 1.0 | — |
| Potassium sulfite | 10.0 | 40.0 |
| Sodium succinate | 12.0 | 12.0 |
| Water ad | 1.0 l | 1.0 l |
| pH (adjusted with nitric acid and KOH) | 5.5 | 5.0 |
| (Stabilizing bath) (common to mother solution and replenisher) | (unit: g) | |
| Polyoxyethylene-p-monononyl phenyl ether (average degree of polymerization: 10) | 0.2 | |
| Sodium chloroisocyanurate | 0.02 | |
| Deionized water (conductivity: 5 μs/cm or below) | 1000 ml | |
| pH | 6.5 | |

The iodine ion concentration in each bleach-fixing solution in the running equilibrium was analyzed by ion chromatography. Then the sample was exposed (10 MCM) through a wedge and processed with the processing solution which had reached the running equilibrium. The amount of silver remaining in the maximum concentration-part of the processed sample was determined with fluorescent X-rays. Further, the reading accuracy of the magnetic recording was determined in the same manner as that of Example 1. The results are shown in Table 4.

TABLE 4

| Bleach-fixing solution | | | Amount of | | |
|---|---|---|---|---|---|
| Kind | Amount of replenisher ($ml/m^2$) | Iodine ion conc. (mol/l) | remaining silver ($\mu g/cm^2$) | Error rate | Remarks |
| 31 A | 65 | 0.024 | 33.3 | 0.13 | Comp. Ex. |
| 32 A | 130 | 0.013 | 31.0 | 0.12 | ditto |
| 33 A | 260 | 0.007 | 28.8 | 0.12 | ditto |
| 34 A | 390 | 0.006 | 24.3 | 0.12 | ditto |
| 35 A | 520 | 0.004 | 22.3 | 0.12 | ditto |
| 36 A | 650 | 0.003 | 19.8 | 0.11 | ditto |
| 37 B | 65 | 0.024 | 31.1 | 0.12 | ditto |
| 38 B | 130 | 0.013 | 29.6 | 0.11 | ditto |
| 39 B | 260 | 0.007 | 23.4 | 0.11 | ditto |
| 40 B | 390 | 0.006 | 22.8 | 0.11 | ditto |
| 41 B | 520 | 0.004 | 16.9 | 0.11 | ditto |
| 42 B | 650 | 0.003 | 13.4 | 0.10 | ditto |
| 43 C | 65 | 0.024 | 5.6 | 0.010 | Present invention |
| 44 C | 130 | 0.013 | 3.1 | 0.006 | ditto |
| 45 C | 260 | 0.007 | 2.5 | 0.005 | ditto |
| 46 C | 390 | 0.006 | 2.3 | 0.005 | ditto |
| 47 C | 520 | 0.004 | 2.5 | 0.005 | ditto |
| 48 C | 650 | 0.003 | 4.8 | 0.009 | ditto |

The bleach-fixing solution C of the present invention containing both thiosulfate radical and compound of the general formula (I) of the present invention had remarkably improved desilvering properties and reading accuracy of magnetic recording. The most excellent results were obtained when the amount of the replenisher was in the range of 100 to 550 $ml/m^2$.

Supposedly, the excellent results were obtained because the iodine ion concentration in the bleach-fixing solution was in the specified range.

EXAMPLE 5

The surface of a paper support having the both surfaces laminated with polyethylene was subjected to corona discharge treatment. Then a subbing layer comprising gelatin containing sodium dodecylbenzenesulfonate was formed thereon and further photographic constituent layers were formed thereon to form a multi-layer color printing paper (101) haivng a laminate structure which will be described below. The coating solutions were prepared as follows:

Preparation of coating solution for forming the first layer 122.0 g of yellow coupler (ExY), 15.4 g of color image stabilizer (Cpd-1), 7.5 g of color image stabilizer (Cpd-2) and 16.7 g of color image stabilizer (Cpd-3) were dissolved in 44 g of solvent (Solv-1) and 180 ml of ethyl acetate. The resultant solution was emulsion-dispersed in 1000 g of 10% aqueous gelatin solution containing 86 ml of 10% sodium dodecylbenzenesulfonate to obtain a emulsified dispersion A. Separately, a silver chlorobromide emulsion A [a mixture of a large grain size emulsion A having an average grain size of 0.88 μm and a small grain size emulsion A having an average grain size of 0.70 μm in a molar ratio of 3:7 (in terms of Ag)] was prepared. The coefficient of variation of the grain size distribution was 0.08 and 0.10 in both emulsions, respectively. In both emulsions, 0.3 molar % of silver bromide was locally contained in a part of the grain surface mainly comprising silver chloride. Blue-sensitive sensitizing dyes A, B and C were added to the large-size grain emulsion A each in an amount of $8.0\times10^{-5}$ mol per mol of silver and they were added to the small-size grain emulsion A in an amount of $1.0\times10^{-4}$ mol. The chemical aging of the emulsion was conducted by adding a sulfur sensitizer and gold sensitizer. The emulsified dispersion A prepared as described above was mixed with this silver chlorobromide emulsion A to obtain a solution to be used for forming the first layer, which had a composition which will be described below. The amount of the emulsion used for coating is given in terms of silver.

Coating solutions for forming the second to the seventh layers were prepared in the same manner as that of the preparation of the coating solution for forming the first layer. Sodium salt of 1-hydroxy-3,5-dichloro-s-triazane was used as the hardener for gelatin in the respective layers.

Cpd-12, Cpd-13, Cpd-14 and Cpd-15 were incorporated into the respective layers so that the total amounts of them would be 15.0 $mg/m^2$, 60.0 $mg/m^2$, 5.0 $mg/m^2$ and 10.0 $mg/m^2$, respectively.

Spectral sensitizing dyes listed below were incorporated into the silver chlorobromide emulsions for forming the photosensitive emulsion layers.

Blue-sensitive emulsion layer:

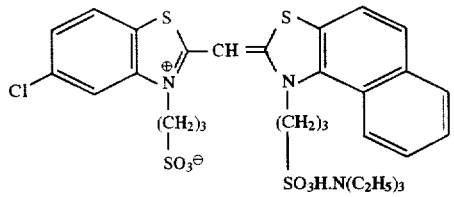

Sensitized dye A

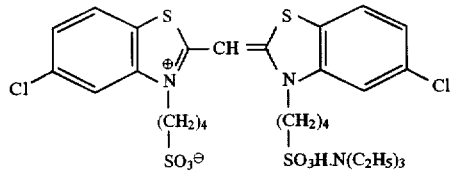

Sensitized dye B

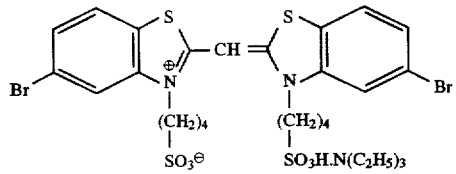

Sensitized dye C (in amounts of $8.0 \times 10^{-5}$ mol and $1.0 \times 10^{-4}$ mol, per mol of the silver halide, for the large-size grain emulsion and small-size grain emulsion, respectively).

Green-sensitive emulsion layer:

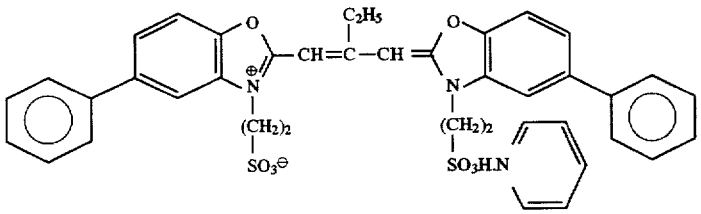

Sensitized dye D

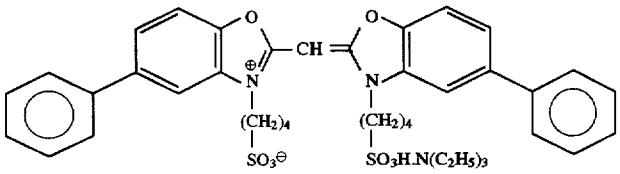

Sensitized dye E

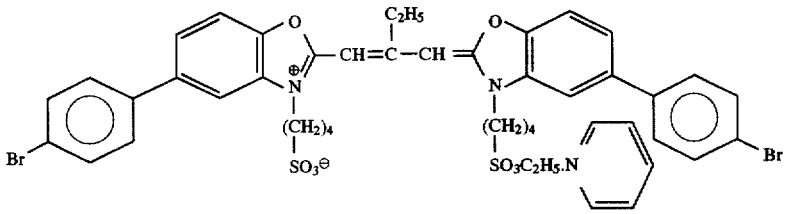

Sensitized dye F ($3.0 \times 10^{-4}$ mol, per mol of the silver halide, of sensitizing dye D, $4.0 \times 10^{-5}$ mol of sensitizing dye E and $2.0 \times 10^{-4}$ mol of sensitizing dye F were added.)

Red-sensitive emulsion layer:

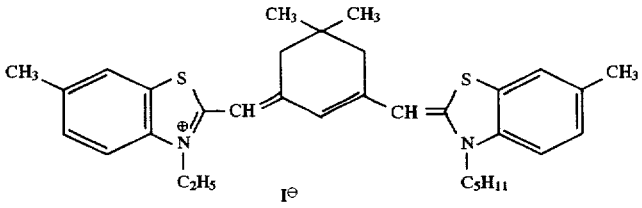

Sensitized dye G

-continued

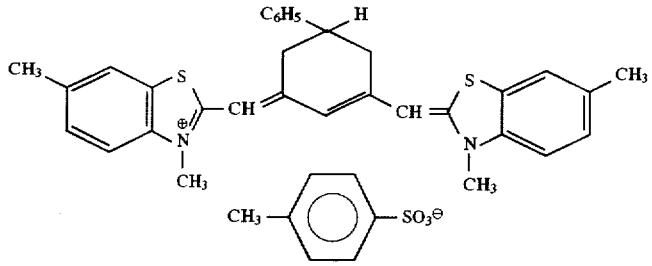

Sensitized dye H (in amounts of $5.0 \times 10^{-5}$ mol, per mol of the silver halide, for the large-size grain emulsion and $8.0 \times 10^{-5}$ mol for the small-size grain emulsion).

In addition, the following compound was added in an amount of $2.6\times10^{-3}$ mol per mol of the silver halide.

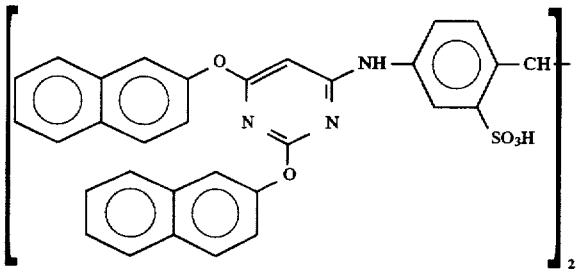

1-(5-Methylureidophenyl)-5-mercaptotetrazole was added to the blue-sensitive emulsion layer, green-sensitive emulsion layer and red-sensitive emulsion layer in amounts of $3.3\times10^{-4}$ mol, $1.0\times10^{-3}$ mol and $5.9\times10^{31\ 4}$ mol, respectively, per mol of the silver halide.

This compound was added to the second, fourth, sixth and seventh layers in an amount of 0.2 mg/m$^2$, 0.2 mg/m$^2$, 0.6 mg/m$^2$ and 0.1 mg/m$^2$, respectively.

4-Hydroxy-6-methyl-1,3,3a,7-tetrazaindene was added to the blue-sensitive emulsion layer and green-sensitive emulsion layer in amounts of $1\times10^{-4}$ mol and $2\times10^{-4}$ mol, respectively, per mol of the silver halide.

Further, the following dye was incorporated into the emulsion layer for prevention of irradation (the numeral in the parentheses being the amount).

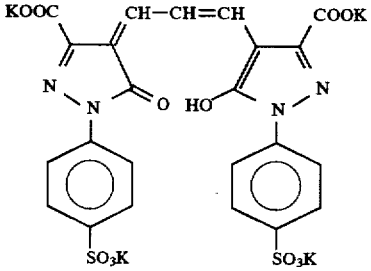

(10 mg/m$^2$)

-continued and

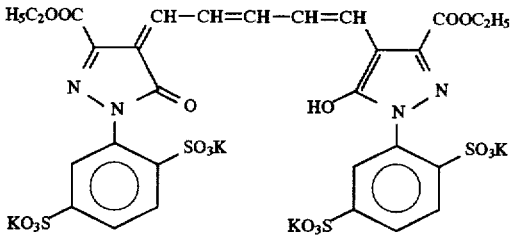

(40 mg/m$^2$)

(Layer constitution)

The composition of each layer will be given below. The numerals indicating the amount of the coating solution are given by g/m$^2$. The amount of the silver halide emulsion is given in terms of silver.

Support

Polyethylene-laminated paper [containing a white pigment ($TiO_2$) and bluing dye (ultramarine) in the polyethylene on the first layer side]

| | |
|---|---|
| The first layer (blue-sensitive emulsion layer) | |
| The above-described silver chlorobromide emulsion A | 0.24 |
| Gelatin | 1.33 |
| Yellow coupler (ExY) | 0.61 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.22 |
| The second layer (color-mixing inhibiting layer) | |
| Gelatin | 1.09 |
| Color-mixing inhibitor (Cpd-4) | 0.11 |
| Solvent (Solv-1) | 0.07 |
| Solvent (Solv-2) | 0.25 |
| Solvent (Solv-3) | 0.19 |
| Solvent (Solv-7) | 0.09 |
| The third layer (green-sensitive emulsion layer) | |
| Silver chlorobromide emulsion [cubic; a mixture of large size grain emulsion B having average grain size of 0.50 μm and small size grain emulsion B having average grain size of 0.40 μm in a molar ratio of 3:7 (in terms of Ag); the coefficient of variation of the grain size distribution being 0.08 and 0.10, respectively; and 1.0 molar % of AgBr being localized in a part of the grain surface mainly comprising silver chloride in both emulsions] | 0.11 |
| Gelatin | 1.19 |
| Magenta coupler (ExM) | 0.12 |
| UV absorber (UV-1) | 0.12 |
| Color image stabilizer (Cpd-2) | 0.01 |
| Color image stabilizer (Cpd-5) | 0.01 |
| Color image stabilizer (Cpd-6) | 0.01 |
| Color image stabilizer (Cpd-7) | 0.08 |
| Color image stabilizer (Cpd-8) | 0.01 |
| Compound (Cpd-16) | 0.0001 |
| Solvent (Solv-4) | 0.30 |
| Solvent (Solv-5) | 0.15 |
| Antifoggant (Cpd-17) | 0.001 |
| The fourth layer (color-mixing inhibiting layer) | |
| Gelatin | 0.77 |
| Color-mixing inhibitor (Cpd-4) | 0.08 |
| Solvent (Solv-1) | 0.05 |
| Solvent (Solv-2) | 0.18 |
| Solvent (Solv-3) | 0.14 |
| Solvent (Solv-7) | 0.06 |
| The fifth layer (red-sensitive emulsion layer) | |
| Silver chlorobromide emulsion [cubic; a mixture of large-size grain emulsion C having average grain size of 0.54 μm and small-size grain emulsion C having average grain size of 0.48 μm in a molar ratio of 1:4 (in terms of Ag); the coefficient of variation of the grain size distribution being 0.09 and 0.11, respectively; and 0.8 molar % of AgBr being localized in a part of the grain surface mainly comprising silver chloride in both emulsions] | 0.18 |
| Gelatin | 0.80 |
| Cyan coupler (ExC) | 0.28 |
| Ultraviolet absorber (UV-3) | 0.19 |
| Color image stabilizer (Cpd-1) | 0.24 |
| Color image stabilizer (Cpd-6) | 0.01 |
| Color image stabilizer (Cpd-8) | 0.01 |
| Color image stabilizer (Cpd-9) | 0.04 |
| Color image stabilizer (Cpd-10) | 0.01 |
| Solvent (Solv-1) | 0.01 |
| Solvent (Solv-6) | 0.21 |
| The sixth layer (ultraviolet absorbing layer) | |
| Gelatin | 0.64 |
| Ultraviolet absorber (UV-2) | 0.39 |
| Color image stabilizer (Cpd-7) | 0.05 |
| Solvent (Solv-8) | 0.05 |
| The seventh layer (protective layer) | |
| Gelatin | 1.01 |
| Acryl-modified polyvinyl alcohol copolymer (degree of modification: 17%) | 0.04 |
| Liquid paraffin | 0.02 |
| Surfactant (Cpd-11) | 0.01 |

-continued
(ExY-1) Yellow coupler
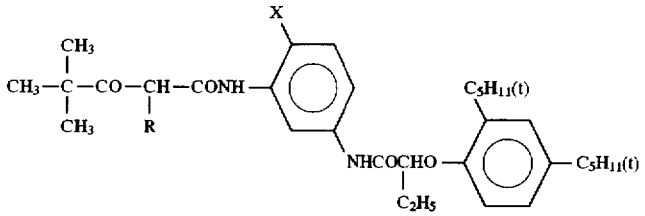
R =
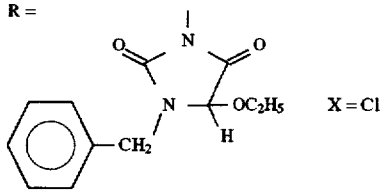
X = Cl
(ExM) Magenta coupler
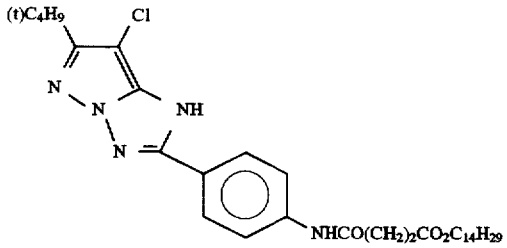
(ExC-1) Cyan coupler
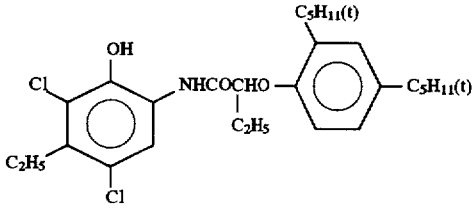
and
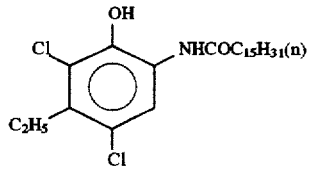
in a mixture of 25:75 (molar ratio)
(ExH) Antifoggant
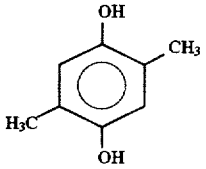
Mw 138
(Cpd-1) Dye stabilizer
$\left(CH_2-\underset{\underset{CONHC_4H_9(t)}{|}}{CH}\right)_n$ , number-average molecular weight 60,000

-continued
(Cpd-2) Dye stabilizer
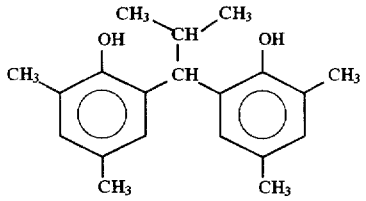
(Cpd-3) Dye stabilizer
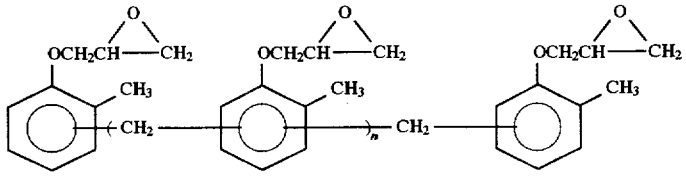
n = 7 ~ 8 (average)
(Cpd-4) Color amalgamation preventing agent
(1)
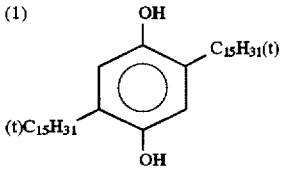
(2)
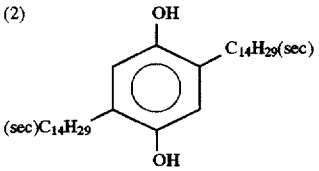
(3)
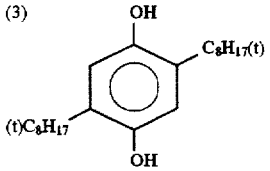
in a mixture of (1):(2):(3) of 1:1:1 (weight ratio)
(Cpd-5) Dye stabilizer
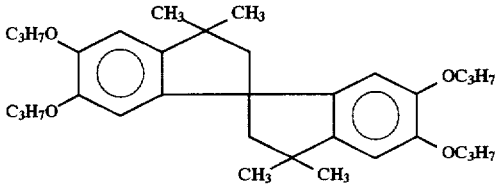
(Cpd-6) Dye stabilizer
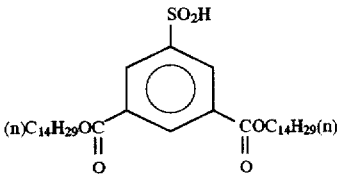
(Cpd-7) Dye stabilizer
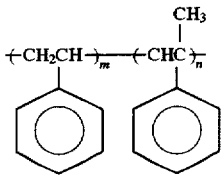
number-average molecular weight 600 m/n = 9/1

-continued
(Cpd-8) Dye stabilizer
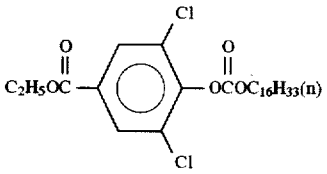
(Cpd-9) Dye stabilizer
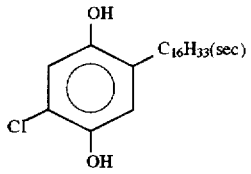
(Cpd-10) Dye stabilizer
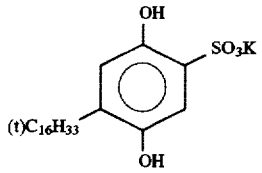
(Cpd-11) Surfactant
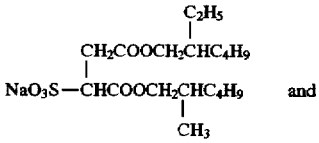
and
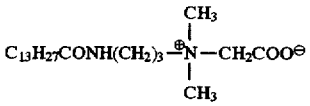
in a mixture of 7:3 (weight ratio)
(Cpd-12) Preservative
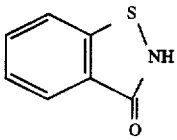
(Cpd-13) Preservative
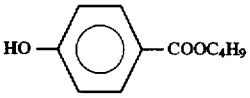
(Cpd-14) Preservative
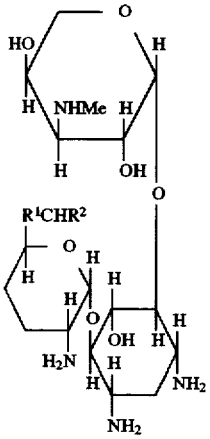
| | $R^1$ | $R^2$ |
|---|---|---|
| a | —Me | —NHMe |
| b | —Me | —$NH_2$ |
| c | —H | —$NH_2$ |
| d | —H | —NHMe |
in a mixture of a:b:c:d of 1:1:1:1

-continued
(Cpd-15) Preservative
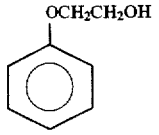
(Cpd-16)
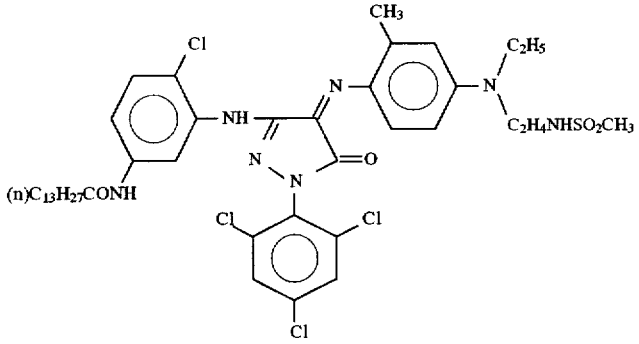
(Cpd-17) Antifoggant
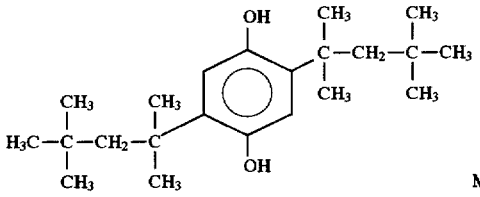
M. W. = 334.5
(UV-1) Ultraviolet absorber
(1)
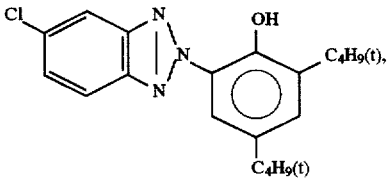
(2)
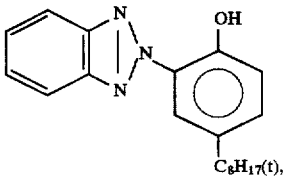
(3)
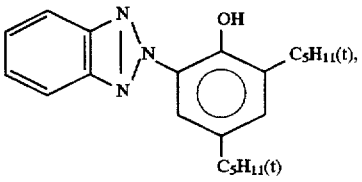
in a mixture of (1):(2):(3) of 1:3:4 (weight ratio)
(UV-2) Ultraviolet absorber
(1)
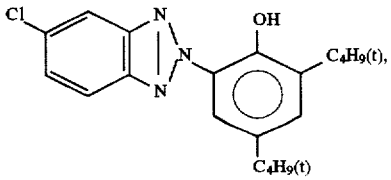
(2)
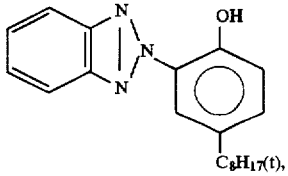

-continued
(3)
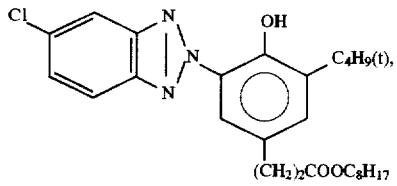
(4)
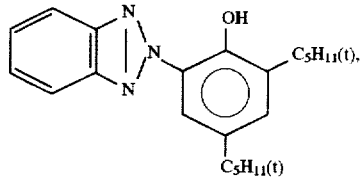
(5)
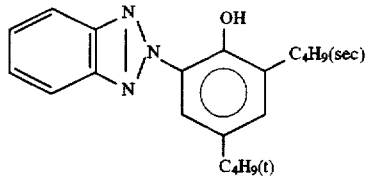
in a mixture of (1):(2):(3):(4):(5) of 1:2:2:3:1 (weight ratio)
(UV-3) Ultraviolet absorber
(1)
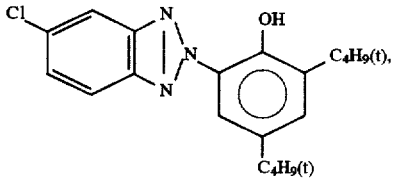
(2)
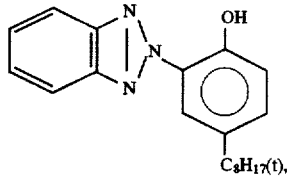
(3)
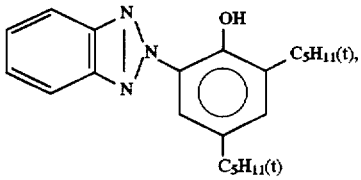
(4)
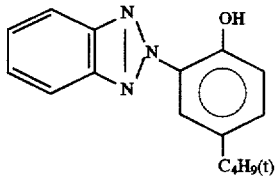
in a mixture of (1):(2):(3):(4) of 1:3:2:1 (weight ratio)
(Solv-1) Solvent
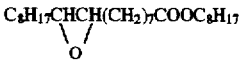
(Solv-2) Solvent
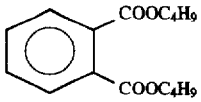
(Solv-3) Solvent
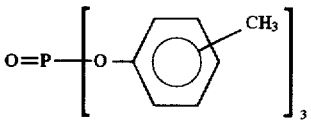
(Solv-4) Solvent
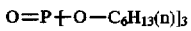
(Solv-5) Solvent
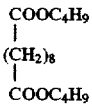
(Solv-6) Solvent
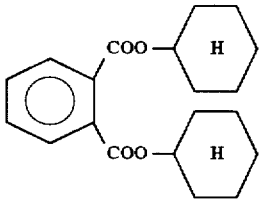

-continued

| (Solv-7) Solvent | (Solv-8) Solvent |
|---|---|
| 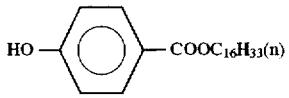 | $COOC_8H_{17}$<br>\|<br>$(CH_2)_8$<br>\|<br>$COOC_8H_{17}$ |

After the image-wise exposure, the running test was conducted with Mini-Lab Processor PP 1250V (a product of Fuji Photo Film Co., Ltd.) for color papers by a method comprising the following processing steps until the total quantity of the replenisher had become 2.5 times as much as the capacity of the bleach-fixing tank. The composition of the bleach-fixing replenisher was controller as shown below:

| Processing step | Temp. | Time | Amount of replenisher* |
|---|---|---|---|
| Color development | 38.5° C. | 45 sec | 45 ml |
| Bleach-fixing | 38° C. | 90 sec | 60 ml |
| Rinse (1) | 38° C. | 20 sec | — |
| Rinse (2) | 38° C. | 20 sec | — |
| Rinse (3)** | 38° C. | 20 sec | — |
| Rinse (4)** | 38° C. | 30 sec | 90 ml |

The rinsing was conducted by counter-current method from (4) to (1) with four tanks.
*The quantity of the replenisher was given per $m^2$ of the photosensitive material.
**The rinse (3) was connected with RC-50 (a product of Fuji Photo Film Co., Ltd.) so as to send the rinsing solution from the rinse (3) into a reverse osmosis membrane module (RC-50). The water from this device was fed into the rinse (4) and the concentrated liquid was returned into the rinse (3). The pump pressure was controlled so that the quantity of water passing through the reverse osmosis membrane module would be kept in the range of 200 to 300 ml/min. The operation was conducted for 10 hours per day.

The composition of each of the processing liquids was as follows:

| [Color developer] | | Mother solution | Replenisher |
|---|---|---|---|
| Cation-exchanged water | | 800 ml | 800 ml |
| Triethanolamine | | 14.5 g | 14.5 g |
| Potassium hydroxide | | 3.0 g | 10.0 g |
| Ethylenediaminetetraacetic acid | | 4.0 g | 4.0 g |
| Sodium 4,5-dihydroxybenzene-1,3-disulfonate | | 0.5 g | 0.5 g |
| Potassium chloride | | 10.0 g | — |
| Potassium bromide | | 0.04 g | — |
| Fluorescent brightener (WHITEX 4; a product of Sumitomo Chemical Co., Ltd.) | | 1.0 g | 4.0 g |
| Sodium sulfite | | 0.1 g | 0.2 g |
| Disodium-N,N-bis(sulfonatoethyl) hydroxylamine | | 8.5 g | 11.1 g |
| N-Ethyl-N-(β-methanesulfonamidoethyl)-3-methyl-4-aminoaniline 3/2sulfate monohydrate | | 5.0 g | 15.7 g |
| Potassium carbonate | | 26.3 g | 26.3 g |
| Water | ad | 1000 ml | 1000 ml |
| pH (with potassium hydroxide or sulfuric acid) at 25° C.) | | 10.15 | 12.45 |

| [Bleach-fixing solution D] | | Mother solution | Replenisher |
|---|---|---|---|
| Water | | 700 ml | 600 ml |
| Potassium thiosulfate | | 0.5 mol | 1.0 mol |
| Sodium sulfite | | 15.0 g | 30.0 g |
| Sodium ferric ethylenediaminetetraacetate | | 40.0 g | 80.0 g |
| Imidazole | | 7.7 g | 16.5 g |
| Water | ad | 1000 ml | 1000 ml |
| pH (with nitric acid or ammonia water at 25° C.) | | 7.00 | 6.00 |

-continued

| [Bleach-fixing solution E] | | Mother solution | Replenisher |
|---|---|---|---|
| Water | | 700 ml | 600 ml |
| Compound II-3 | | 0.5 mol | 1.0 mol |
| Sodium sulfite | | 15.0 g | 30.0 g |
| Sodium ferric ethylenediaminetetraacetate | | 40.0 g | 80.0 g |
| Imidazole | | 7.7 g | 16.5 g |
| Water | ad | 1000 ml | 1000 ml |
| pH (with nitric acid or ammonia water at 25° C.) | | 7.00 | 6.00 |

| [Bleach-fixing solution F] | | Mother solution | Replenisher |
|---|---|---|---|
| Water | | 700 ml | 600 ml |
| Compound II-3 | | 0.05 mol | 0.1 mol |
| Potassium thiosulfate | | 0.45 mol | 0.9 mol |
| Sodium sulfite | | 15.0 g | 30.0 g |
| Sodium ferric ethylenediaminetetraacetate | | 40.0 g | 80.0 g |
| Imidazole | | 7.7 g | 16.5 g |
| Water | ad | 1000 ml | 1000 ml |
| pH (With nitric acid or ammonia water at 25° C.) | | 7.00 | 6.00 |

| [Bleach-fixing solution G] | | Mother solution | Replenisher |
|---|---|---|---|
| Water | | 700 ml | 600 ml |
| Compound II-3 | | 0.05 mol | 0.1 mol |
| Potassium thiosulfate | | 0.45 mol | 0.9 mol |
| Sodium sulfite | | 15.0 g | 30.0 g |
| Sodium ferric ethylenediaminetetraacetate | | 40.0 g | 80.0 g |
| Imidazole | | 7.7 g | 16.5 g |
| Compound IV-25 | | 12.5 g | 25.0 g |
| Water | ad | 1000 ml | 1000 ml |
| pH (with nitric acid or ammonia water at 25° C.) | | 7.00 | 6.00 |

(Rinsing water) (common to mother liquid and replenisher)

| | |
|---|---|
| Sodium chlorinated isocyanurate | 0.02 g |
| Deionized water (conductivity: 5 μs/cm or below) | 1000 ml |
| pH | 6.5 |

After the completion of the running test, the amount of silver remaining in the maximum density part and the yellow density of the unexposed part were determined. The results are shown in Table 5.

TABLE 5

| No. | Bleach-fixing solution | Amount of remaining silver | DBmin |
|---|---|---|---|
| 50 | D | 16.4 | 0.14 |
| 51 | E | 13.8 | 0.14 |
| 52 | F | 2.3 | 0.10 |

When the bleach-fixing solution F comprising the combination of the present invention with thiosulfate radical was used, excellent results were obtained in both desilvering and stain-proofing functions.

EXAMPLE 6

The same procedure as that in Example 5 was repeated except that compound II-3 in the bleach-fixing solution F was replaced with an equimolar amount of compound I-2, I-6, II-12 or II-20 to obtain excellent results.

Thus, according to the process of the present invention, a low ammonium salt concentration, and excellent fixing function can be attained and, in addition, even when the replenisher for the bleach-fixing solution or fixing solution is fed in only a small amount, a low stain density and excellent photographic properties can be obtained.

What is claimed is:

1. A method for processing a silver halide photosensitive photographic material which comprises the steps of developing an image-exposed silver halide photosensitive material and desilvering it with a processing solution having fixing function which contains a thiosulfate radical and a compound selected from the group consisting of the compounds represented by the following general formulae (I) and (II), an amount of ammonium ion in the solution being 0 to 50% based on the total counter cations in the solution: general formula (I)

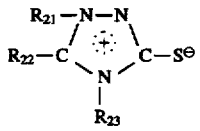

wherein $R_{21}$, $R_{22}$ and $R_{23}$, which may be the same or different from each other, each represents a hydrogen atom, alkyl group, cycloalkyl group, alkenyl group, alkynyl group, aralkyl group, aryl group, heterocyclic group, amino group, acylamino group, sulfonamido group, ureido group, sulfamoylamino group, acyl group, thioacyl group, carbamoyl group or thiocarbamoyl group, with the proviso that both $R_{21}$ and $R_{23}$ cannot be a hydrogen atom at the same time, and general formula (II):

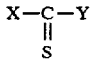

wherein X and Y, which may be the same or different from each other, each represents an alkyl group, alkenyl group, aralkyl group, aryl group, heterocyclic group, $—N(R_{31})R_{32}$, $—N(R_{33})\ N(R_{34})\ R_{35}$, $—OR_{36}$ or $—SR_{37}$, or X may together form a ring, with the proviso that at least one of X and Y is substituted with a carboxylic acid or its salt, sulfonic acid or its salt, phosphonic acid or its salt, amino group, ammonium group or hydroxyl group; $R_{31}$, $R_{32}$, $R_{33}$, $R_{34}$ and $R_{35}$ may be the same or different from each other and each represents a hydrogen atom, alkyl group, alkenyl group, aralkyl group, aryl group or heterocyclic group, and $R_{36}$ and $R_{37}$ may be the same or different from each other and each represents a hydrogen atom, cation, alkyl group, alkenyl group, aralkyl group, aryl group or heterocyclic group, wherein the processing solution having fixing function contains the thiosulfate radical and the compound represented by the general formula (I) or (II) in a molar ratio of 1:0.02 to 1:0.30.

2. The method of claim 1, wherein the alkyl, cycloalkyl, alkenyl, alkynyl, aralkyl and aryl groups represented by $R_{21}$, $R_{22}$ and $R_{23}$ each have 1 to 10 carbon atoms.

3. The method of claim 1, wherein $R_{21}$, $R_{22}$ and $R_{23}$ each represent a hydrogen atom or alkyl group having 1 to 5 carbon atoms.

4. The method of claim 1, wherein one of $R_{21}$, $R_{22}$ and $R_{23}$ is an alkyl group substituted with a water-soluble group selected from the group consisting of a hydroxyl group amino group, sulfonic acid group, carboxylic acid group and phosphoric acid group.

5. The method of claim 1, wherein X, Y, $R_{31}$, $R_{32}$, $R_{33}$, $R_{34}$, $R_{35}$, $R_{36}$ and $R_{37}$ each represent an alkyl group having 1 to 10 carbon atoms, alkenyl group having 2 to 10 carbon atoms, aralkyl group having 7 to 12 carbon atoms, aryl group having 6 to 12 carbon atoms, heterocyclic groups having 1 to 10 carbon atoms.

6. The method of claim 1, wherein $R_{38}$ and $R_{37}$ each represent an alkali metal or ammonium group.

7. The method of claim 1, wherein the compounds represented by the general formula (II) are those represented by the following general formula (III):

general formula (III):

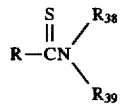

wherein R represents an alkyl group having 1 to 10 carbon atoms, $—N(R_{40})\ R_{41}$ having 0 to 10 carbon atoms or $—N(R_{42})N(R_{43})\ R_{44}$ having 0 to 10 carbon atoms, $R_{38}$, $R_{39}$, $R_{40}$, $R_{42}$, $R_{43}$ and $R_{44}$ each represent a hydrogen atom or alkyl group (preferably having 1 to 5 carbon atoms), with the proviso that at least one of R, $R_{38}$, $R_{39}$, $R_{40}$, $R_{41}$, $R_{42}$, $R_{43}$ and $R_{44}$ represents an alkyl group substituted with a carboxylic acid or a salt thereof, sulfonic acid or salt thereof, phosphonic acid or salt therrof, amino group, ammonium group or hydroxyl group.

8. The method of claim 7, wherein R represents $—N(R_{40})\ R_{41}$ having 0 to 6 carbon atoms or $—N(R_{42})N(R_{43})R_{44}$ having 0 to 6 carbon atoms and $R_{40}$, $R_{41}$, $R_{42}$, $R_{43}$ and $R_{44}$ each represent a hydrogen atom or alkyl group with the proviso that one to four of $R_{40}$, $R_{41}$, $R_{42}$, $R_{43}$ and $R_{44}$ represents an alkyl group substituted with a group selected from the group consisting of carboxylic acid groups, salts, thereof, sulfonic acid groups and salts thereof.

9. The method of claim 1, wherein the solution having fixing function contains iodine ions in an amount of 0.003 to 0.03 mole/liter.

10. The method of claim 1, wherein an amount of replenisher for the solution having fixing function which is fed into a bath having the fixing function is 100 to 550 ml per one $m^2$ of the silver halide photosensitive photographic material to be processed.

11. The method of claim 1, wherein the solution having fixing function contains a compound of the following general formula (IV):

general formula (IV):

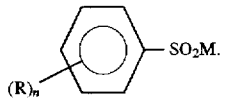

12. The method of claim 1, wherein the solution having fixing function is a bleach-fixing solution.

13. The method of claim 1, wherein the silver halide photosensitive photographic material is a color photosensitive photographic material.

14. The method of claim 1, wherein the silver halide photosensitive material has at least one red-sensitive layer, at least one green-sensitive layer, at least one blue-sensitive layer and a magnetic layer containing a ferromagnetic fine powder on a transparent support.

15. The method of claim 14, wherein the transparent support is made from polyester.

16. The method of claim 14, wherein the magnetic layer is formed as a back layer.

17. The method of claim 1, wherein an emulsion layer of the silver halide photosensitive photographic material comprises silver bromoiodide emulsion.

* * * * *